United States Patent [19]

Asai

[11] Patent Number: 5,056,338

[45] Date of Patent: Oct. 15, 1991

[54] YARN POSITIONING CONTROLLER FOR FLAT-BED KNITTING MACHINES

[75] Inventor: Naohito Asai, Nagoya, Japan

[73] Assignee: Brother Kogyo Kabushiki Kaisha, Aichi, Japan

[21] Appl. No.: 535,138

[22] Filed: Jun. 8, 1990

[30] Foreign Application Priority Data

Jun. 14, 1989 [JP] Japan ..... 1-151181

[51] Int. Cl.[5] ..... D04B 15/52

[52] U.S. Cl. ..... 66/127

[58] Field of Search ..... 66/125 R, 126 R, 127, 66/128, 129

[56] References Cited

U.S. PATENT DOCUMENTS

| | | | |
|---|---|---|---|
| 3,911,700 | 10/1975 | Tschumperlin | 66/127 |
| 4,111,007 | 9/1978 | Yokoyama | 66/125 R |
| 4,354,363 | 10/1982 | Inoue | 66/128 |

FOREIGN PATENT DOCUMENTS

| | | | |
|---|---|---|---|
| 2112628 | 8/1972 | Fed. Rep. of Germany | 66/125 R |
| 1-266251 | 10/1989 | Japan | 66/125 R |
| 1-266252 | 10/1989 | Japan | 66/125 R |
| 2-61142 | 3/1990 | Japan | 66/125 R |
| 2-68340 | 3/1990 | Japan | 66/125 R |

*Primary Examiner*—Wm. Carter Reynolds

*Attorney, Agent, or Firm*—Oliff & Berridge

[57] ABSTRACT

A flat bed knitting machine having a pair of yarn support racks on opposite sides of the knitting section of its needle bed, each support rack having a plurality of holders each adapted to detachably hold one of a plurality of yarns. Each yarn has a pair of associated holders with one holder being positioned in each support rack. The holders are individually actuatable between transfer and withdrawn positions. A controller is provided to actuate the holders and move the carriage back and forth in response to stored information in order to preset the yarns into predetermined initial positions that are desired to commence knitting.

5 Claims, 19 Drawing Sheets

16a
16b
18
1 2 3 4 5 6
6 5 4 3 2 1
1 0 1 0 1 0
0 1 0 1 0 1
S5
Is the carriage at left end position ?
S6
Is the setting of collars on both sides finished ?
S7
Is the setting of collars on right side finished ?
S17
Is the collar to be used at right side ?
S8
Set electromagnets.
S9
Move carriage rightwardly.
S14
Turn off electromagnets.
S19
Stop carriage
End
YES
NO
1
2

YARN POSITIONING CONTROLLER FOR FLAT-BED KNITTING MACHINES

This application is related to co-pending U.S. application Ser. No. 07/530,806, now U.S. Pat. No. 5,022,239 (which corresponds to Japanese Application No. 1-138576 filed May 30, 1989), the contents of which are incorporated herein by reference.

FIELD OF THE INVENTION

The present invention relates generally to controlling yarn changing devices for flat bed knitting machines. More particularly, the described controller automatically is used in conjunction with a knitting machine that is capable of utilizing a multiplicity of yarns, each of which may be stored at a plurality of locations.

Flat bed knitting machines are generally well known. For example, U.S. Pat. No. 3,911,700 discloses a knitting machine having a storage rack on one side of the knitting machine. A plurality of yarn guide collars are detachably held within the storage rack. A carriage is provided on the main body of the knitting machine. The carriage is arranged to move back and forth along a needle bed and has a yarn changing device thereon. The yarn changing device is capable of picking collars from the storage rack at one end of the needle bed and includes a collar support member arranged to hold a selected collar. In order to change yarns during the knitting operation, the carriage moves to the end of the needle bed adjacent the collar supporting device. The particular collar holding the desired yarn is then exchanged for the collar currently held by the carriage. In this manner, patterns having multiple colors can be knitted by changing the yarns used during the knitting operation. Although such devices are capable of knitting fabric having multiple colors, they have certain undesirable limitations. For example, since the collar supporting device is located at only one end of the needle bed, every time a yarn change is desired, the carriage must travel to the yarn changing end of the needle bed.

U.S. Pat. No. 4,111,007 discloses a yarn changing device for flat-bed knitting machines having an alternative construction. However, like the previously described patent, it contemplates changing the active yarns at only one end of the needle bed. U.S. Pat. No. 4,354,363 discloses a controller for directing the movements of a carriage along the needle bed of a flat bed knitting machine.

SUMMARY OF THE INVENTION

Accordingly, it is an objective of the present invention to provide a controller for a flat bed knitting machine that is capable of automatically positioning the yarns into desired holders located in collar support racks on opposite sides of the needle bed before knitting is initiated.

To achieve the foregoing and other objects and in accordance with the purpose of the present invention, a flat bed knitting machine is provided having an elongated needle bed that has a knitting section thereon. A carriage is slidably mounted on the needle bed for longitudinal movement relative to the needle bed. The carriage includes a yarn support member capable of selectively receiving a yarn. A pair of support racks are provided on opposite sides of the knitting section. Each support rack is designed to hold a plurality of yarns.

Both support racks have a plurality of holders for detachably holding an associated yarn. Each yarn has an associated holder in each support rack. The holders each have a transfer position and a withdrawn position. A holder driving arrangement is provided for moving the holders between their withdrawn and transfer positions to facilitate transferring the yarns between said yarn support member and their associate holders. A carriage driving arrangement moves the carriage back and forth along the needle bed. A controller is provided to direct the holder driving arrangement and the carriage driving arrangement in response to stored information in order to preset the yarns into the initial positions desired to commence knitting.

In a preferred embodiment, the holders are pairs such that each yarn has an associated holder pair. The various holder pairs are arranged sequentially from inside to outside of the needle bed such that the inner holder constitute a first holder pair and so on. The yarn arrangement presetting function is then accomplished by only transferring the yarns between their associated holder pairs.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

FIG. 11(*b*) is a front elevational view of the carriage connecting device shown in FIG. 11(*a*).

FIG. 12(*b*) is a front elevational view of the carriage connecting device shown in FIG. 12(*a*).

FIG. 13(*b*) shows the transfer data associated with the yarn distribution state shown in FIG. 13(*a*).

DETAILED DESCRIPTION OF THE PREFERRED EMBODIMENT

Figure 2:
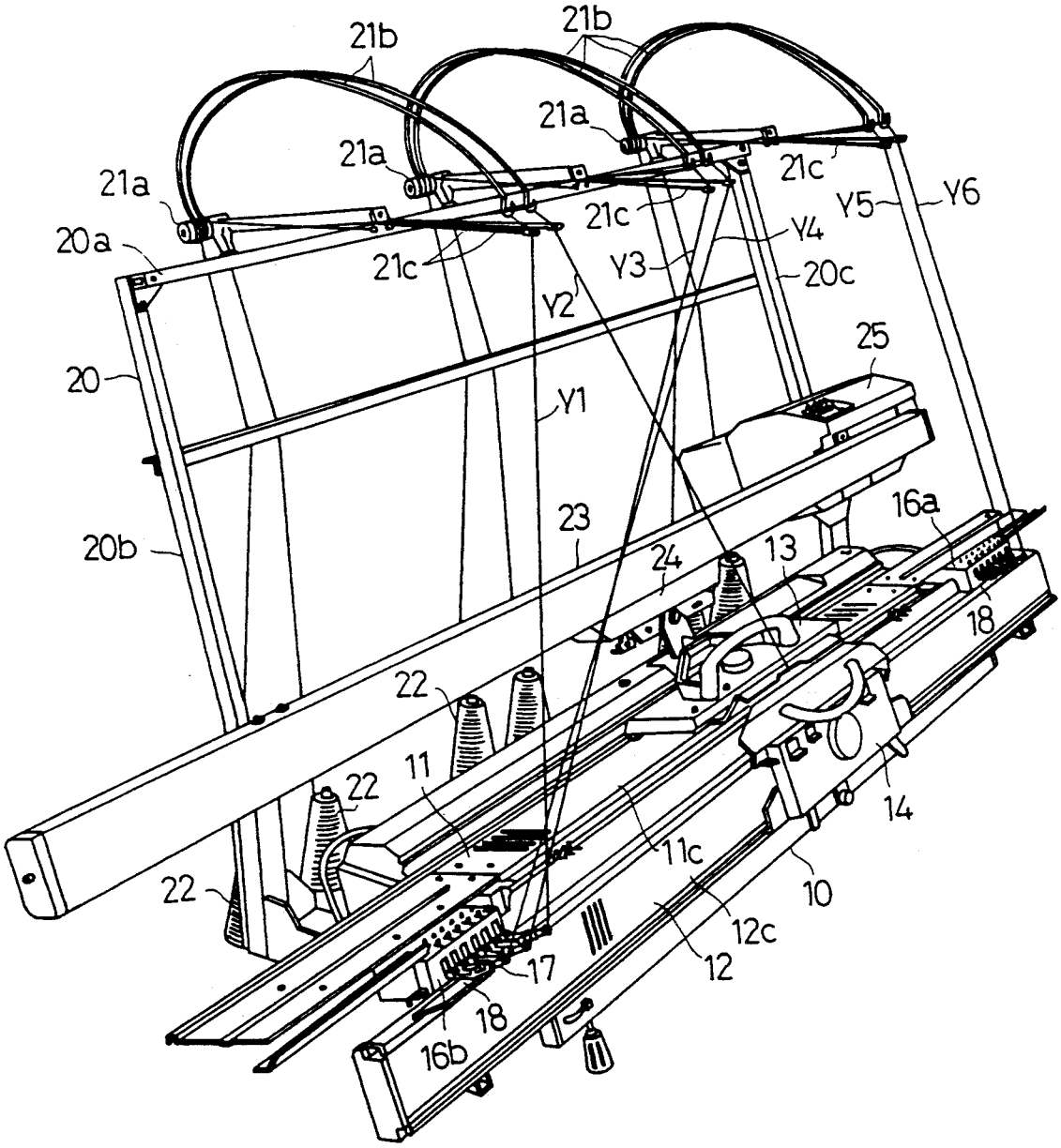
FIG. 2 is a perspective view of a knitting machine built in accordance with the present invention.

A flat bed knitting machine suitable for use with the controller of the present invention will be described with reference to FIGS. 2–12. Referring initially to FIG. 2, the knitting machine includes a pair of adjacent elongated needle beds 11 and 12 that constitute a so-called V-bed knitting machine. Typically, the second needle bed is fastened to the first needle bed in a manner such that it may be readily detached so that the knitting machine 10 may be operated as a single bed machine if desired to produce the particular pattern being knitted. Each needle bed 11, 12, has a multiplicity of corresponding movable latch needles 11*a*, 12*a* and fixed sinkers 11*b*, 12*b* of conventional design. (See FIG. 7). The needles are arranged in needle arrays 11*c* and 12*c* centered along the length of their respective beds. A first carriage 13 is arranged to travel back and forth along the first needle bed 11. Similarly, a second carriage 14 travels back and forth along the second needle bed 12.

Figure 3:
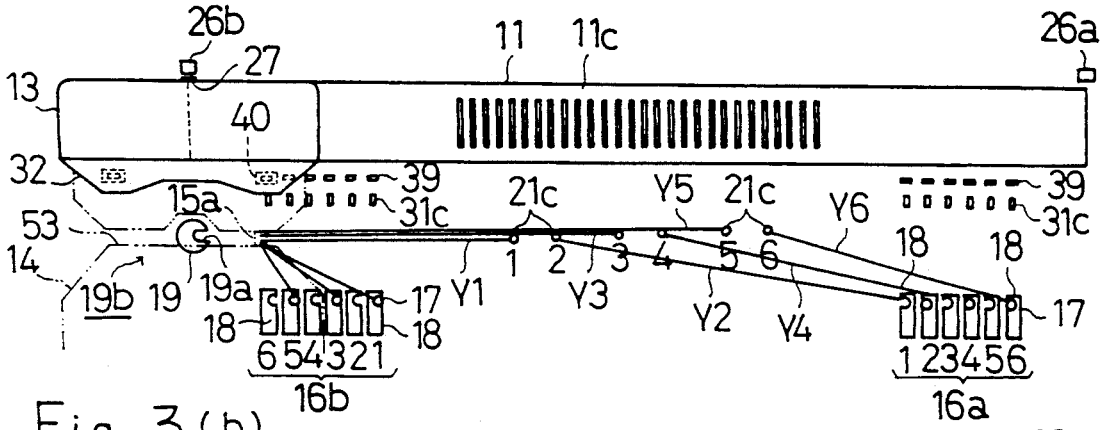
FIGS. 3(*a*)–3(*j*) are sequential schematic drawings of the first needle bed, carriages and collar support racks showing the transfer of yarns between the opposite racks and the yarn changing device.
Figure 3:
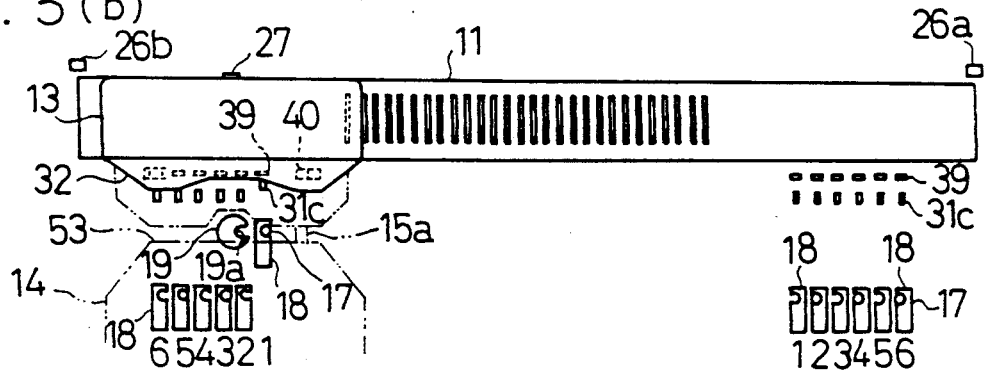
Figure 3:
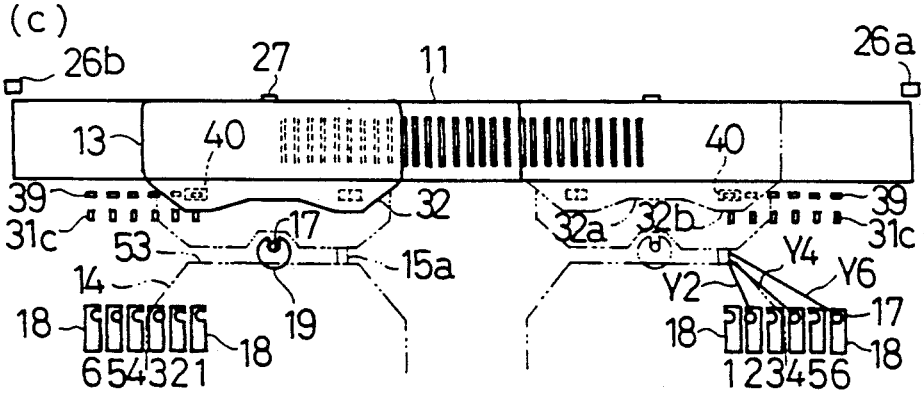
Figure 3D:
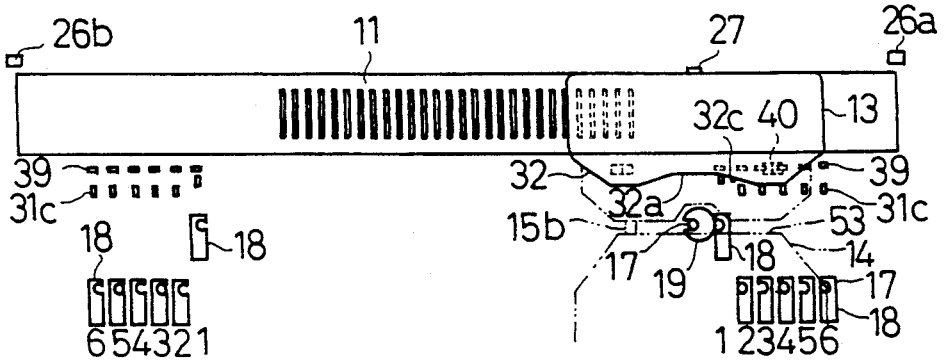

An elongated belt guide bar 23 is mounted to a frame 20 above the first needle bed 11. An endless belt (not shown) is disposed within the belt guide bar 23. A linkage bar 24 couples the endless belt to the first carriage 13. Thus, as best seen in FIG. 3, the carriages 13 and 14 can be moved back and forth along the first needle bed 11 by driving the endless belt in opposite directions within guide bar 23. A control box 25 is mounted to the elongated belt guide bar and houses a reversible motor 117 (indicated in FIG. 1) and the transmission mechanisms (not shown) required to drive the endless belt. A controller 111 is provided to rotate the drive motor in either direction which in turn drives the endless belt that controls the movements of the carriage 13 over the first needle bed 11.

Although directions are of course arbitrary, in the description below, the "right" side of the knitting machine will be considered the side shown to the right in FIG. 2, while the "left" side will be considered the side that appears to the left of the viewer in the same figure. Thus, in the embodiment shown, the control box 25 is mounted on the right side of the belt guide bar 23.

Figure 10:
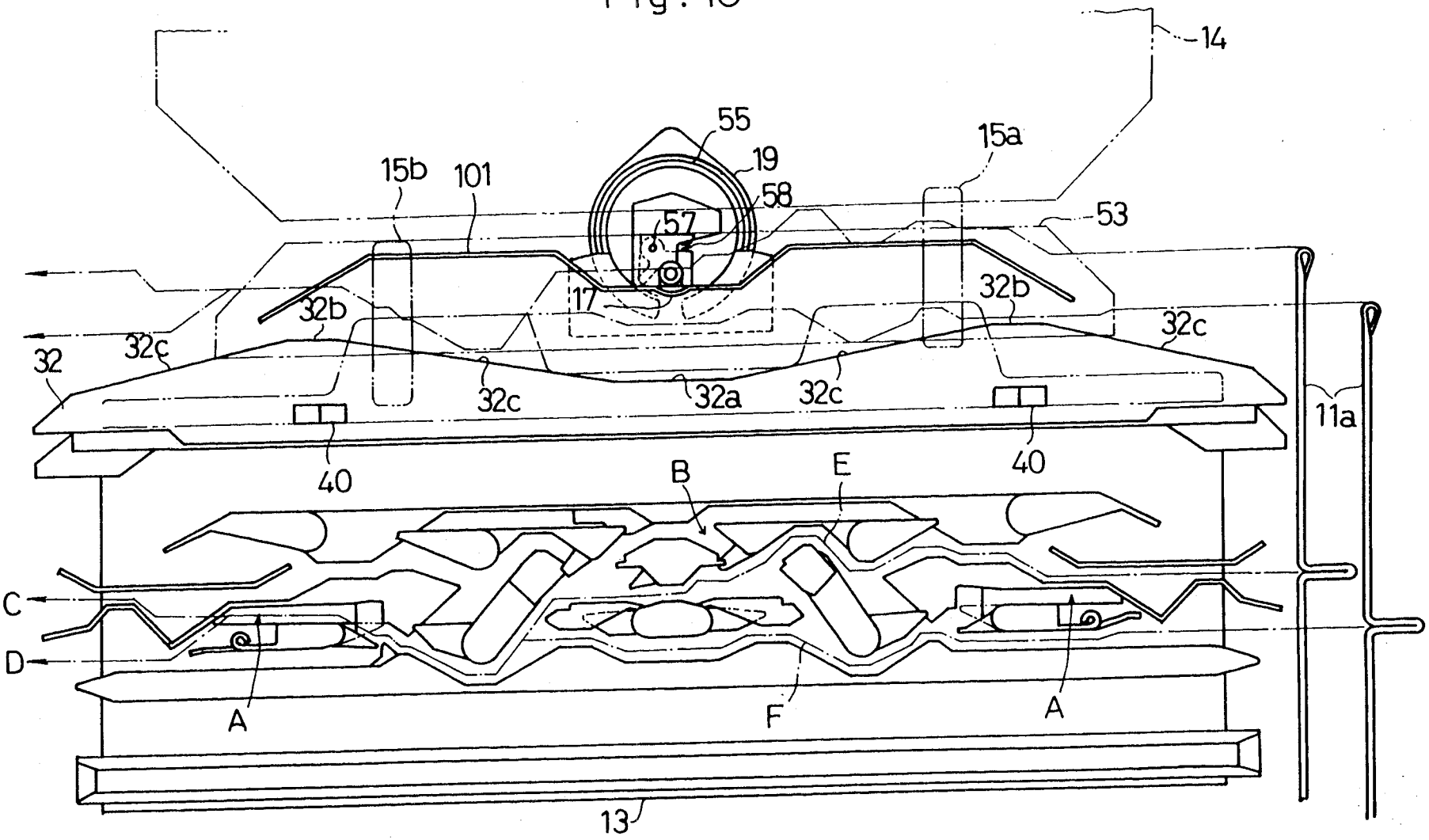
FIG. 10 is a diagrammatic bottom view of the carriage shown in FIG. 8 in the operational position adjacent the needle selecting device.

Referring specifically to FIG. 10, a conventional needle selection device is provided for choosing the desired needles from the needle beds. The needle selection device includes a selector A, knitting passage E, non-knitting passage F, a multiplicity of cams B as well as knitting and non-knitting introduction passages C and D.

The needles are first laid on the needle bed in either a knitting or a non-knitting position, which are staggered relative to one another. Each needle is picked up by the appropriate introduction passage. The needles in the non-knitting position pass through non-knitting passage F to the needle selector A which directs them towards either the knitting or non-knitting introduction passages C and D which lay the needles in the appropriate position for the next pass in the knitting operation. The needles resting in the knitting position pass through the knitting passage E and their passage through cams B directs the knitting actions of the needles. Once the desired knitting actions have been accomplished, these needles also pass by needle selector A which sends them to the appropriate introduction passage to be laid for the next carriage pass.

Carriages 13 and 14 are coupled by a pair of retractable connecting members 15. As seen in FIGS. 3(*a*)–(*j*) and as will be more fully described below, only one of the connecting members engages both of the carriages at a time during normal operations. Thus, when connecting member 15*a* is extended into engagement with the opposing carriage, connecting member 15*b* is withdrawn and vice versa.

A pair of position sensors 26 are provided adjacent opposite ends of the first needle bed 11 outside of the knitting needle array section 11*c*. The position sensors 26 are electronically coupled to the controller and are used to mark the respective ends of the intended travel of carriages 13 and 14. Specifically, right position sensor 26*a* marks the right limit for the carriages movement while left position sensor 26*b* marks the limit of travel to the left. A magnet 27, mounted on the back surface of carriage 13 is detected by the position sensors when the carriage approaches.

Referring next to FIG. 2, a pair of collar support racks 16*a* and 16*b* are provided on opposite ends of the needle beds. The collar support racks are positioned inside of the sensors 26, but a spaced distance outside of the needle array section 11*c*. Each collar rack has a multiplicity of individually accessible collar holders 18. The collar holders 18 each have a recess that is adapted to releasably engage a collar 17. As best seen in FIGS. 3*a*–3*j*, the recesses in the holders in opposing collar racks 16*a* and 16*b* face one another. Each of the holders 18 is movable between an active transfer position and a passive holding position. The knitting machine is arranged so that the holders 18 can communicate with a collar support member 19 on the yarn changing device 19*b* when the holders are in the active position. Although the actual number of holders provided within each collar support rack 16 will vary in accordance with the size and scale of the knitting machine, the number of holders 18 provided in each rack 16 will equal the number of yarns that the machine is capable of working with. Thus, both racks have the same number of holders 18. In the embodiment chosen for the purpose of illustration, the knitting machine is capable of handling six yarns. Thus, each rack 16 houses six collar holders 18. These holders are labeled 1–6 in the FIGS. 3*a*–3*j*.

A plurality of collars 17 are provided with each collar being adapted to hold a single yarn. The collars 17 are elongated tubular cylinders each having an axial bore extending therethrough. The yarns are passed though the axial bore of their associated collar. Again, although the actual number of yarns Y used in a particular application will vary depending upon the desired fabric pattern, the described machine is capable of handling six different yarns Y1–Y6 and therefore, the description and drawings describe a device wherein six yarns Y1–Y6 are used. Accordingly, six yarn guide collars 17 are provided with each being associated with a particular yarn Y1–Y6.

Figure 3E:
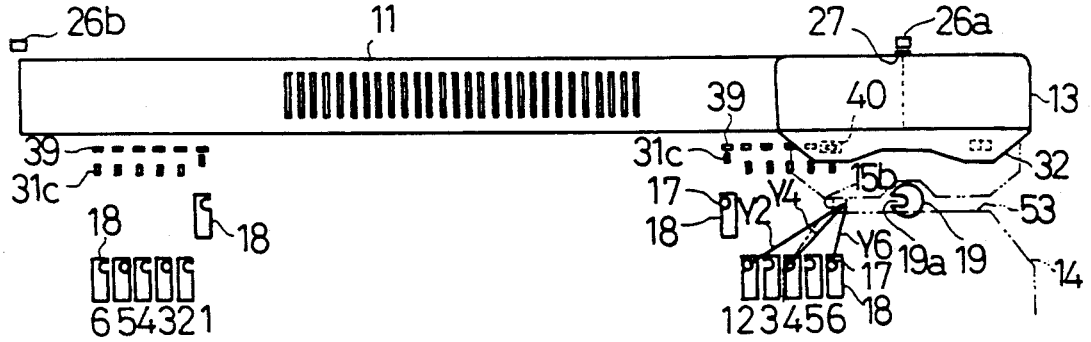

The yarn changing device 19*b* has a collar support member 19 that is adapted to cooperate with the collar holders 18 to transfer yarn between the collar racks 16 and the working portion of the knitting machine. The collar support member 19 is rotatable over a range of approximately 180 degrees. A yarn recess 19*a*, which is formed in the support member 19 is adapted to releasably engage a single collar 17. The collar support member 19 has three working positions. These include two transfer positions and an operational position. In a first transfer position as shown in FIG. 3*a*, the yarn support recess 19*a* is oriented such that it faces the right side of the knitting machine. In this position, yarn collars 17 can be effectively transferred between the left collar support rack 16*a* and the yarn changing device 19*b*. In a second transfer position, as shown in FIG. 3*e*, the yarn support recess 19*a* is oriented to face the left side of the knitting machine. In this position, transfers can occur between the yarn changing device and the right collar rack 16*a*. In the third position, the yarn support recess 19*a* faces the fabric being knitted in an operational position to provide the needles 11*a* and 12*a* with the particular yarns carried by the active yarn guide collar 17. The yarn changing device is arranged so that the collar support member only rotates in the regions between the knitting needles array and the respective racks.

Referring next to FIG. 2, the frame 20 carries a plurality of yarn tensioning devices 21*a*. Each of the yarn tensioning devices is arranged to apply tension to a pair of the yarns Y1–Y6. Each tensioning device 21*a* includes a tensioning spring 21*b* and a pair of yarn guides 21*c*. In the described embodiment, three yarn tensioning devices are provided. Thus, there are six yarn guides 21*c*, with each yarn guide handling a single one of the yarns Y1–Y6. The yarns Y1–Y6, originate at yarn supply sources 22 and are threaded through their associated yarn guide 21*c* and guide collar 17.

The tips of the yarn guides are staggered front to back so that the yarns do not interfere with one another regardless of their respective positions relative to the needle beds. In the illustrated embodiment, this is accomplished by offsetting the frame 20. Specifically, the frame 20 includes an upper horizontal support member 20*a* and a pair of upwardly extending support members 20*b* and 20*c*. In the embodiment chosen for the purpose of illustration, the left upwardly extending support member is bent backwards so that the left side of horizontal support member 20*a* is somewhat behind its right side. By way of example, in a machine having a carriage travel of approximately one meter, an offset of eight centimeters would be appropriate. In such an arrangement, the three yarn tensioning devices 21*a* may be equidistantly spaced, as for example, 35 centimeters apart. It should be appreciated that with such an arrangement, when the various yarns are crossed during operation and/or storage at either of the opposing collar support racks 16, the yarns held by a given yarn guide 21*c* will pass in back of yarns held by yarn guides positioned to their right, while they will pass in front of yarns held by yarn guides positioned to their left. Thus, they remain clear of entanglement during operation of the knitting machine.

Referring next to FIGS. 3*a*–3*j*, the operation of the knitting machine will be described. The yarns Y1–Y6 are initially threaded through their respective guide collars 17. The collars holding yarns Y1, Y3 and Y5 (hereinafter collars 1, 3 and 5 respectively) are initially placed in their associated holders in the left collar support rack 16*b*. The collars holding yarns Y2, Y4 and Y6 (collars 2, 4 and 6) are placed in their associated holders in the right collar support rack 16*a*. The carriages 13 and 14 are coupled together by connecting members 15*a*. They are initially moved to their leftmost position slightly beyond the left support rack 16*b*. It is noted that in this state, the magnet 27 is located adjacent the left position sensor 26*b*. In this position, the collar support member 19 is oriented in the left transfer position with recess 19*a* facing to the right.

Figure 1:
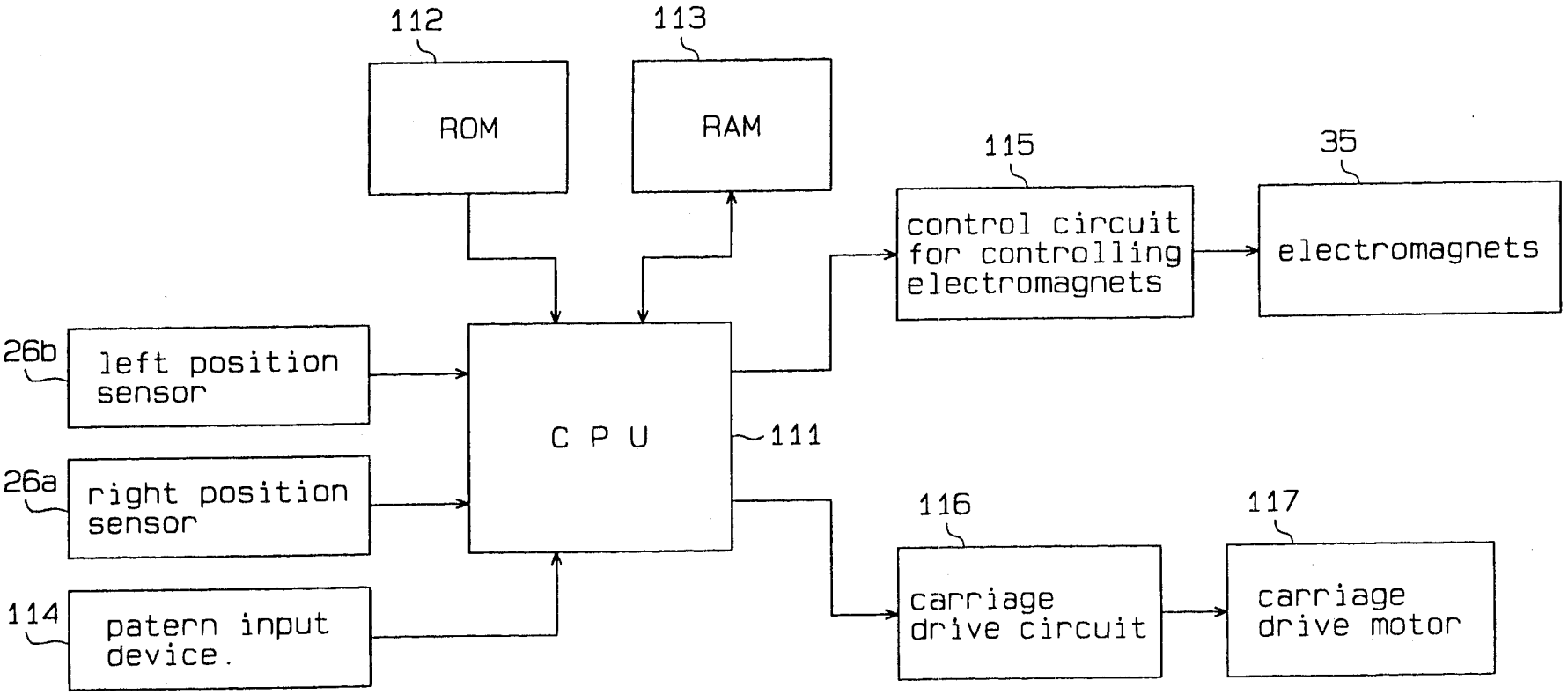
FIG. 1 is a block diagram of a controller for a flat bed knitting machine in accordance with the present invention.

The yarns chosen at any particular stage in a knitting operation will be dependent upon the specific pattern being knitted. The yarn selection may be automatically controlled to produce the desired knitted pattern. A block diagram for the controller is shown in FIG. 1 and is described in detail below. In this description, it is assumed that the first yarn to be knitted is Y1.

To begin knitting, holder #1 within the left support rack 16*b* is rotated to its transfer position as seen in FIG. 3*b*. The carriages 13 and 14 are moved to the right such that the collar support member 19 picks collar #1 from its holder and proceeds towards the right side of the needle bed 11 as seen in FIG. 3*c*. Once the yarn guide collar 17 has been secured within recess 19*a* and the yarn changing device is clear of the support rack 16*b*, the collar support member 19 is rotated 90 degrees so that the recess 19*a* faces the needle bed in the operational knitting position. The rotation occurs as the carriage is moved between the left support rack 16*b* and the left side of the needle array. The carriage then proceeds to move as required to carry out the desired knitting actions. The needle selecting device thus delivers the appropriate needles 11*a* and 12*a* to the active yarn. The knitting operation may then be carried out in a conventional manner. It is noted that with the described rack arrangement, yarns Y3 and Y5 are clear of the yarn passage 53 between the carriages 13 and 14 when the knitting operation occurs. At the same time, the connecting member 15*a*, which couples the carriages together, prevents the yarns Y2, Y4 and Y6 from entering the yarn passage 53. Thus, none of the inactive yarns Y2–Y6 interfere with the knitting operation.

When the desired knitting pattern calls for a change in the yarn being used, the carriages are moved to the end of the knitting bed where the next desired yarn is located and the yarn changing device 19*b* exchanges the active yarn for the desired yarn.

In order to facilitate the description of the exchanging process, it will be assumed that the pattern to be knitted calls for the use of yarn Y6. Since yarn string Y6 is currently located in sixth (#6) holder 18 of the right support rack 16*a*, the carriage is moved towards the right end of the needle bed 11 as seen in FIG. 3*c*. In the region between the needle array and the right support rack 16*a*, the left connecting member 15*b* is extended into engagement between the carriages, while right connecting member 15*a* is withdrawn. Additionally, the collar support member 19 is rotated 90 degrees counterclockwise so that the recess 19*a* faces to the left. The collar holder #1 in right support rack 16*a* is rotated to the transfer position. And the carriages are moved further to the right to obtain the state shown in FIG. 3*d*. As the collar support member 19 passes the first holder in the support rack, the active guide collar #1 is passed to its associated holder in the right support rack 16*a*. As seen in FIG. 3*e*, the carriages then proceed to the extreme right position along their beds which is marked by the position sensor 26*a*.

Figure 3F:
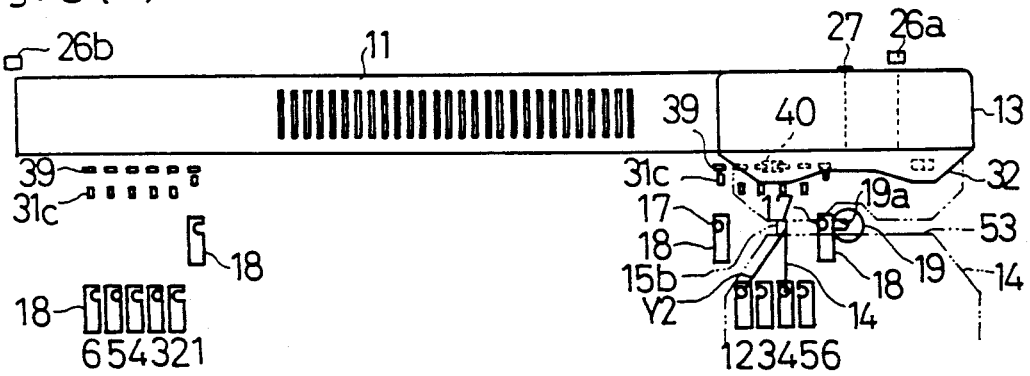
Figure 3:
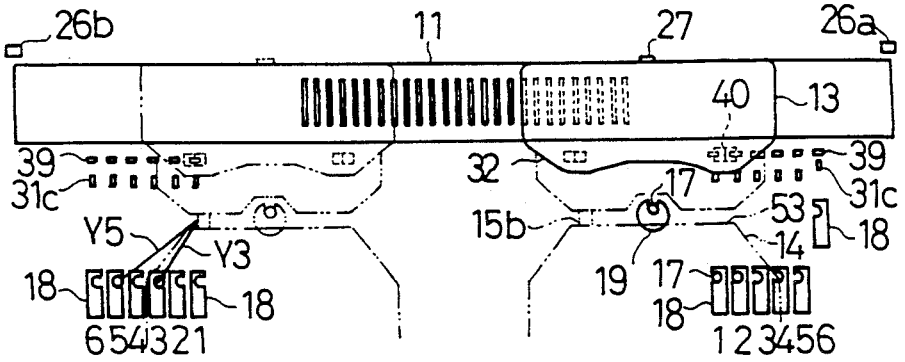
Figure 3:
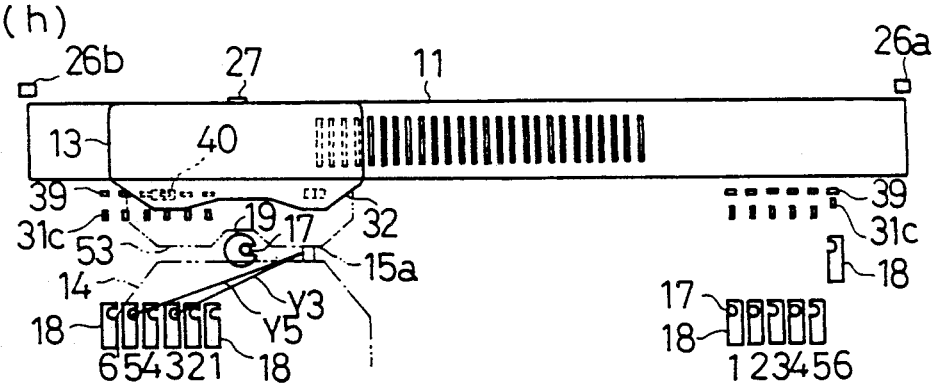
Figure 3:
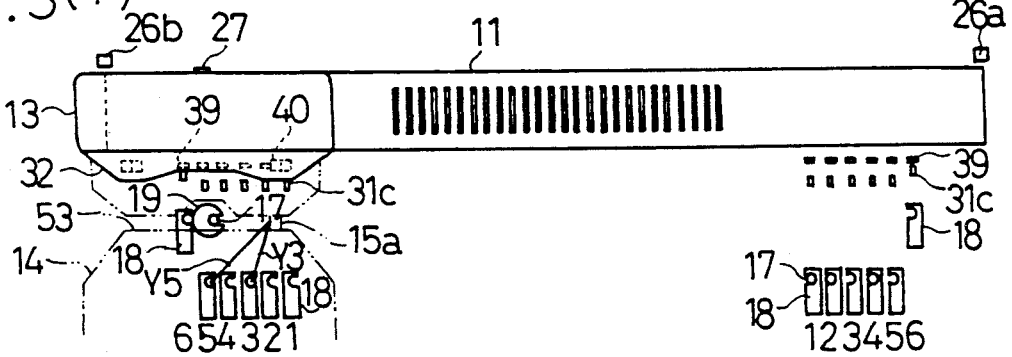
Figure 3:
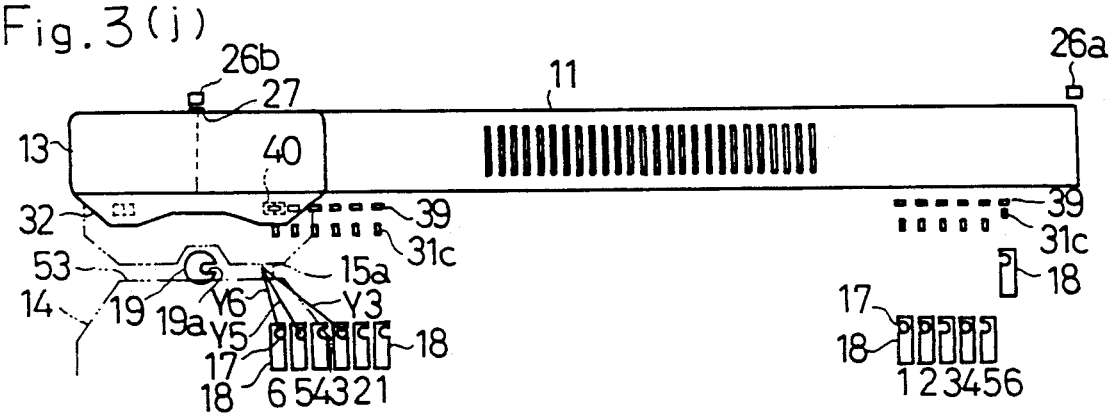

Reference is next made to FIGS. 3*f* and 3*g*. The holder corresponding to the selected yarn is then rotated to the active position. In the example described this is holder #6 in the right support rack 16*a*. The carriages are moved to the left to enable the collar support member 19 to pick the selected yarn for use. The inactive holder #1 is also returned to its withdrawn position. Once the yarn changing device 19*b* clears the support rack, the collar support member is rotated 90 degrees in a clockwise direction so that it assumes the operational position. As before, the selected yarn may be supplied to the needles necessary to knit the desired pattern. If during the movements of the carriage, the connecting member 15*b* comes into contact with the yarns held within the left support rack, they are merely bent out of the way by the left connecting member 15*b*.

When the knitting actions required by the yarn Y6 have been completed, it is replaced in the same manner as described above. It should be appreciated that the exchange can occur at either end of the needle bed, depending upon the actual location of the next selected yarn. When all knitting operations are completed, the active yarn is placed in the support rack from which the original yarn was taken.

In the example above, if no further yarn changes were required, the active yarn collar #6 would be placed in the left support rack 16*b*. To accomplish this, the carriages are moved to the left side of the needle array. FIG. 3*g*. Left connecting member 15*b* is withdrawn, while right connecting member 15*a* is moved into its engagement position. This allows the yarns Y3 and Y5 to enter the passage 53 between carriages 13 and 14. Since yarn Y6 is held by the collar support member, it is also within the passage 53. The collar support member 19 is also rotated 90 degrees in the clockwise direction to its left transfer position as the carriages moves towards the left support rack 16*b*. FIG. 3*h*. Holder #6 in the left support rack is moved to its transfer position and receives the collar that hold yarn Y6 as the yarn changing device 19*b* passes thereby. FIG. 3*i*. Finally, the carriages are parked on the left side of the left support rack as seen in FIG. 3*j* and holder #6 is withdrawn to its holding position. In this arrangement, magnet 27 is aligned with left position sensor 26*b*. If further knitting operations are desired, the carriage would pick the next desired yarn as previously described.

It is noted that the yarns will often cross during the collar exchange. However, since the various yarns are staggered front to back by the yarn guides 21*c*, they do not become entangled.

Figure 4:
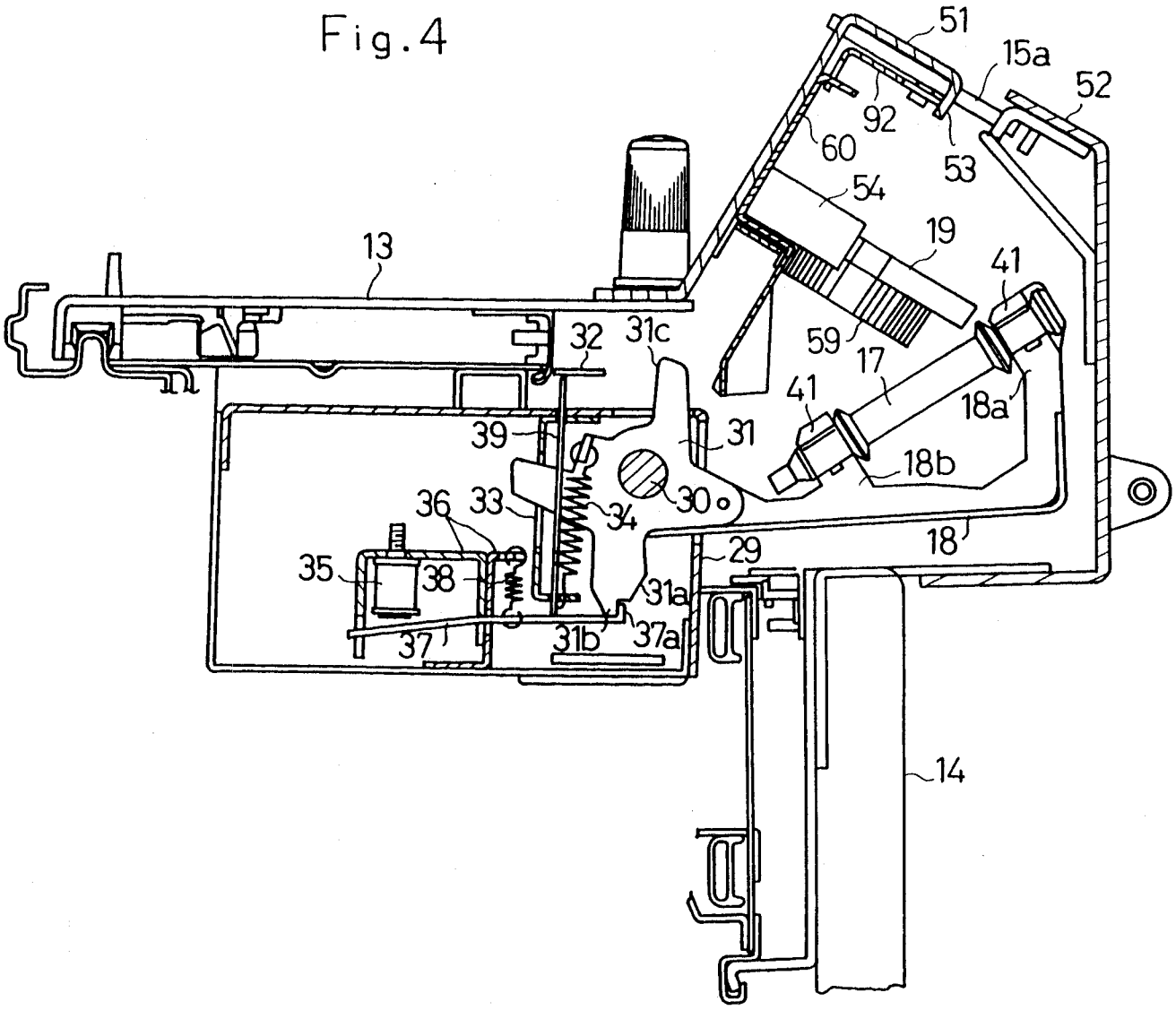
FIG. 4 is a sectional side view of a collar rack for the knitting machine shown in FIG. 2, with its switch lever located in its holding position.
Figure 5:
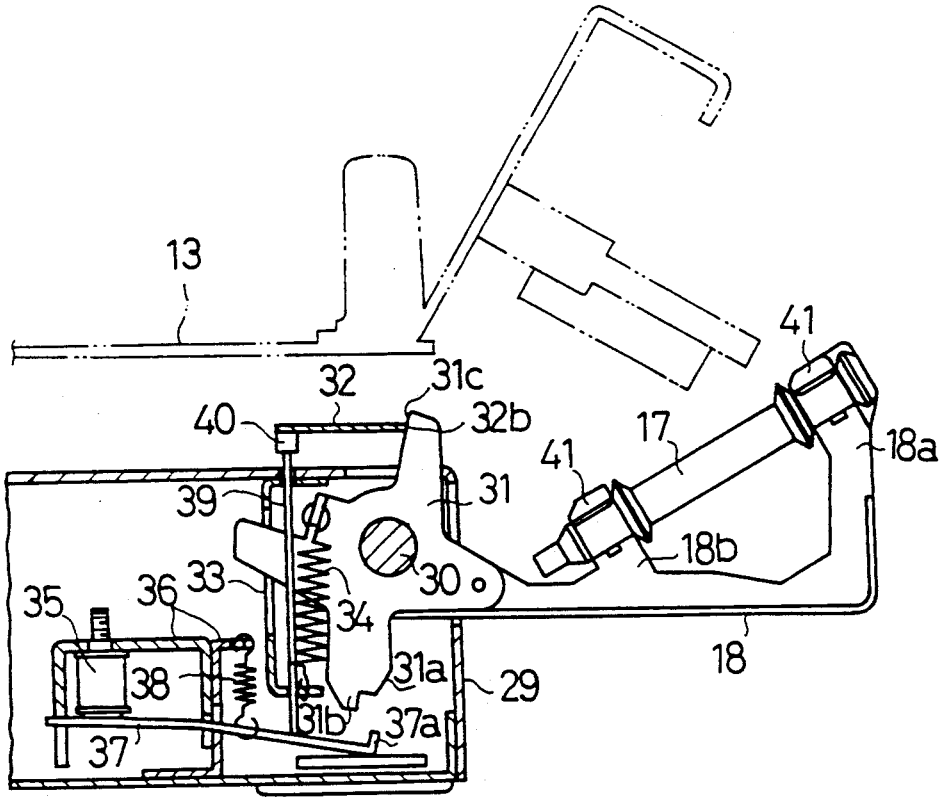
FIG. 5 is a sectional side view of the collar rack shown in FIG. 4 with the switch lever located in its release position.
Figure 6:
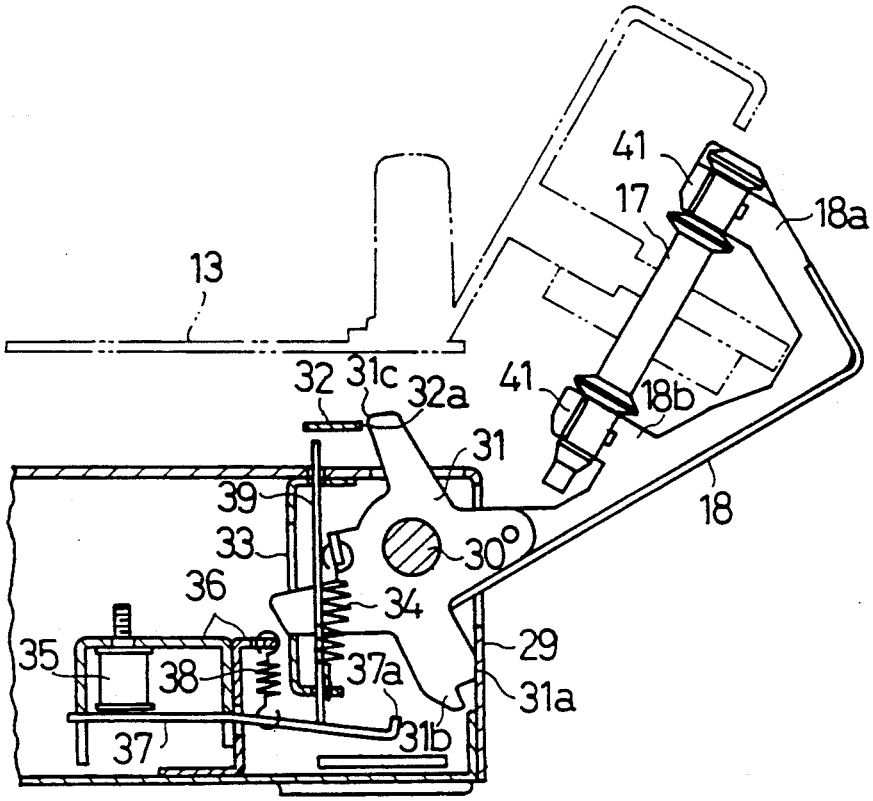
FIG. 6 is a sectional side view of the collar rack shown in FIG. 4 with the collar holder in its transfer position.

Referring next to FIGS. 4–6, the construction of the collar support racks 16 will be described. Since the collar support racks are substantially identical in construction structural details of only one will be described. The collar support rack 16*a* has a frame body 29. Shaft 30, support arm 33 and support member 36 are all mounted to the frame body 29. The shaft 30 is arranged such that its axis lies in parallel with the needle bed 11. A plurality of turn members 31 are independently rotatably mounted on the shaft. One turn member 31 is provided for each collar holder 18. Thus, in the described embodiment, six turn members 31 are provided in each support rack 16. Since the turn members and their associated mechanisms are identical in structure, the construction of only one will be described.

Figure 8:
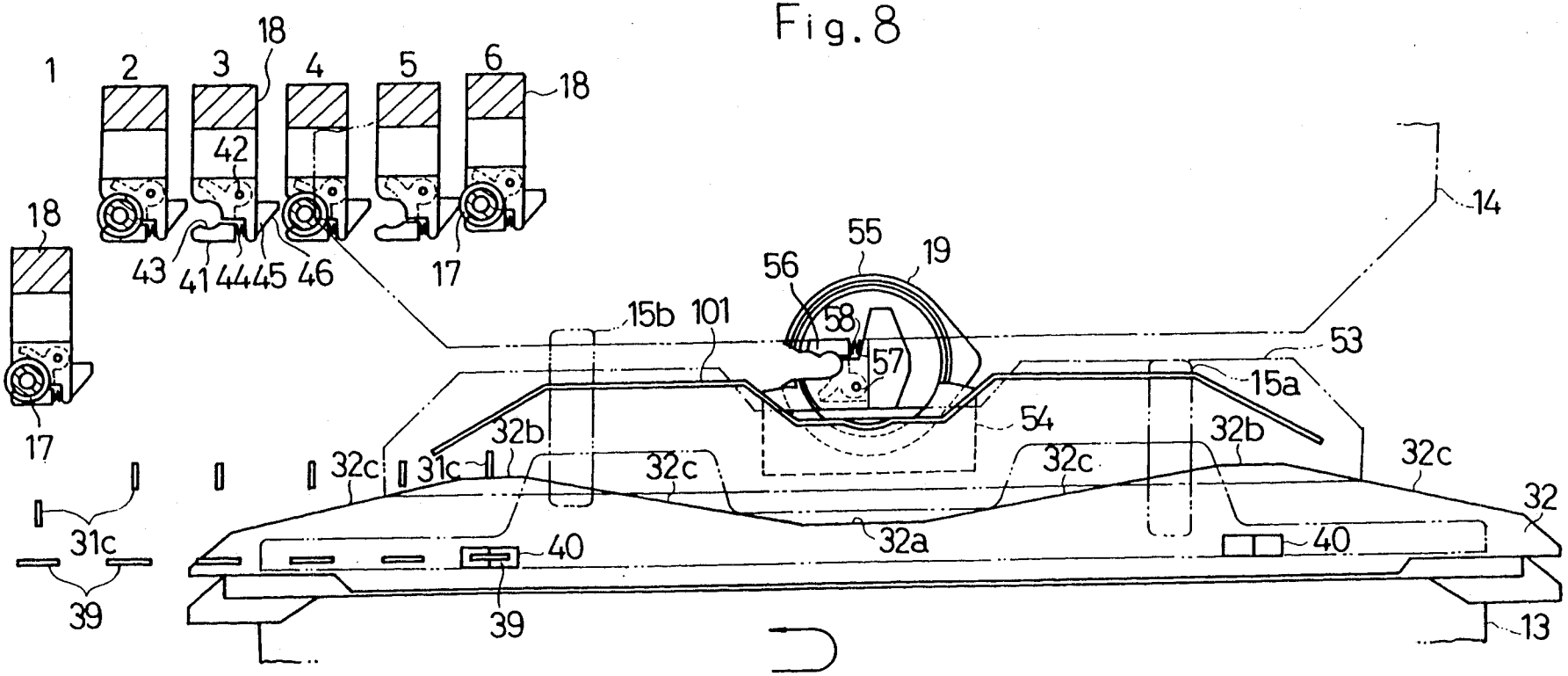
FIG. 8 is a diagrammatic bottom view of the carriage of the knitting machine shown in FIG. 2 in the right transfer position as it initially contacts the right collar rack.
Figure 9:
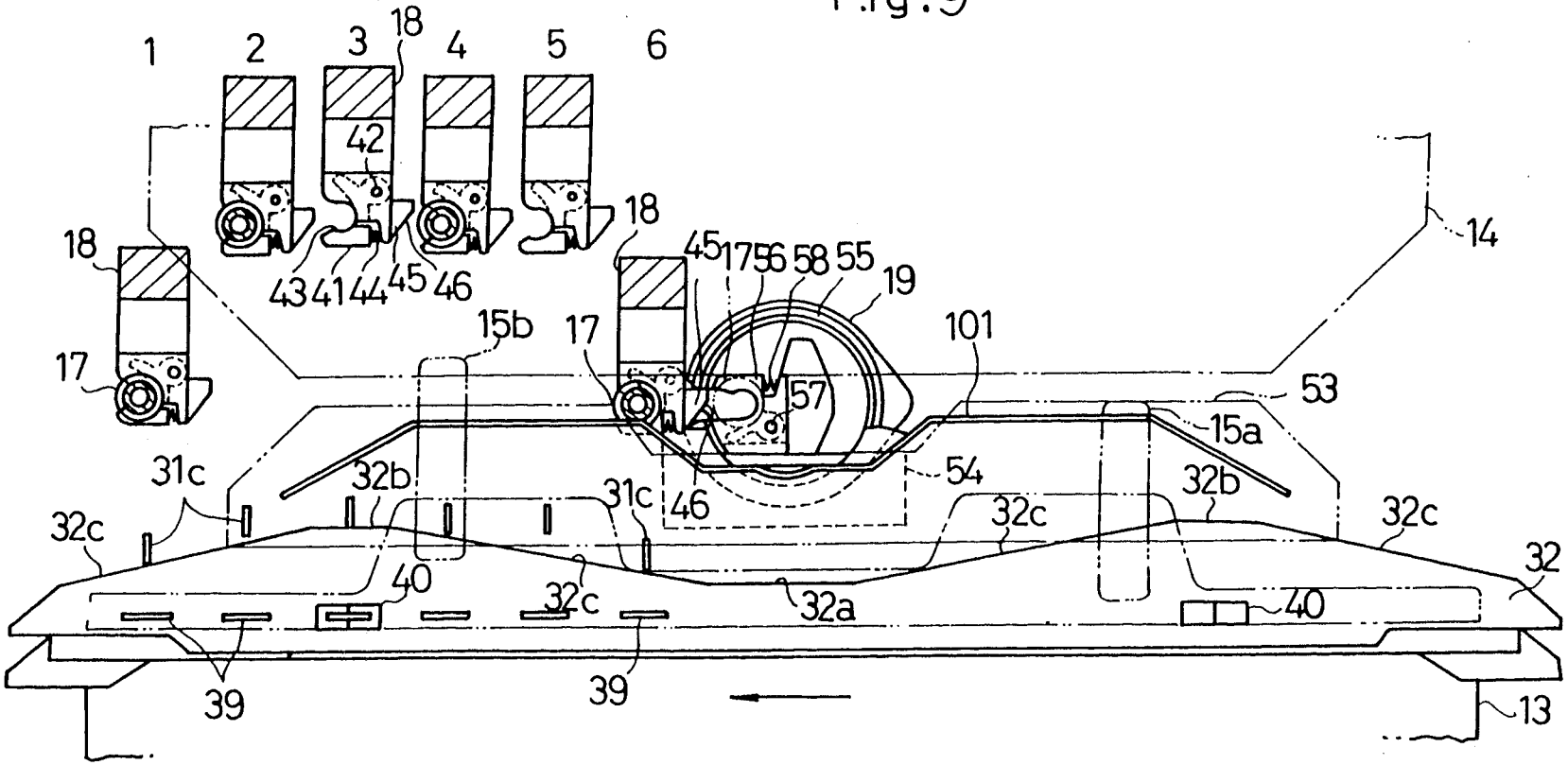
FIG. 9 is a diagrammatic bottom view of the carriage shown in FIG. 8 after it has progressed further into the right collar rack.

As best seen in FIGS. 4–6, each of the turn members 31 has four arms extending radially outward about its periphery. One of the arms carries the turn member's associated collar holder 18. A second arm has a tapered contact surface 31*a* and a finger 31*b*. A third arm 31*c* acts as a contact against cam member 32 carried by the carriage 13 as best seen in FIGS. 8 and 9. The contact surface 31*a* is arranged to rest against the frame 29 when the collar holder 18 is in its transfer position. Thus, in effect, the turn member 31 acts as a stop for positively positioning the collar holder 18 in the transfer position. The finger 31*b* cooperates with a selectively actuatable switch lever 37 to hold the collar holder in the withdrawn position during normal operation of the knitting machine.

A biasing spring 34 is connected between the periphery of turn member 31 and the fixed support arm 33 in order to urge the turn member 31 (and thus the collar holder 18) towards the transfer position. The biasing spring 34 is sized such that absent competing forces, it will rotate the turn member and collar holder into the transfer position.

The contact arm 31*c* is arranged to engage the surface of a camming member 32 carried by the carriage 13. Thus, when the carriage passes a selected holder, the turn member 31 will pivot about the support shaft 30 under the influence of the camming member 32. The shape of camming member 32 is best seen in FIGS. 8 and 9. The camming member 32 is symmetrical about a central valley portion 32*a* that is positioned opposite the collar support member 19. It also has a pair of spaced apart top surfaces 32*b* and inclined guide surfaces 32*c* that slope downward from both sides of each top surface 32*b*. The centrally located inclined guide surfaces lead to the central valley portion 32*a*. A pair of activating cams 40 are provided on the lower surface of the camming member 32 opposite the respective top surfaces 32*b*.

As indicated above, the actuating mechanisms for the collar holders 18 all have identical constructions. Therefore, the construction of only one will be described in detail. The switch lever 37 is loosely carried by support 36 and cooperates with a selectively actuatable electromagnet 35 and a biasing spring 38 to selectively move between release and holding positions. The switch lever 37 has a substantially horizontal orientation although it has a slight bend near its center and an upturned lip 37*a* that cooperates with finger 31*b* on the turn member 31. A vertically extending riser 39 cooperates with the switch lever 37 and extends upwardly through openings in the support arm 33 and frame 29. The biasing spring 38 is connected between the support 36 and switch lever 37 to urge the front side of the switch lever (i.e. the right side as viewed in FIGS. 4–6) upward to a holding position wherein the lip 37*a* engages the finger 31*b* on turn member 31 in order to hold the collar holder 18 is its withdrawn position as seen in FIG. 4. Thus, when the switch lever 37 is in the holding position, it overcomes the forces of spring 34 to hold the collar holder 18 in the withdrawn position.

The activating cams 40 on camming member 32 are arranged to cooperate with risers 39 in order to release the turn member 31 from switch lever 37. Referring specifically to FIGS. 5 and 9, the riser 39 extends well outside the frame 29 in order to cooperate with the activating cam 40. When an activating cam 40 passes over the riser 39, it forces the riser 39 and thus switch lever 37 downward to a release position free from turn member 31. However, at this point, the turn member does not rotate towards the transfer position because the top portion 32*b* of camming member 32 is pressing against contact arm 31*c* of the turn member to hold the turn member in place. FIG. 5.

In order to prevent the activating cam 40 from inadvertently releasing all of the collar holders 18 as it passes, the top portion 32*b* of camming member 32 and the activating cam 40 are sized such that the activating cam will release riser 39 before camming member 32 allows the turn member 31 to rotate sufficiently to stay clear of lip 37*a*. That is, if the particular collar holder 18 being passed by the cam 40 is not to be activated, as activating cam 40 passes, spring 38 lifts the switch lever 37 and riser 39 sufficiently such that lip 37*a* reengages finger 31*a* on turn member 31. In such circumstances, the holding position shown in FIG. 4 is resumed.

If, on the other hand, the associated collar holder is to be lifted to the transfer position, the electromagnet 35 is activated, lifting the back side of the switch lever 37 (the left side as shown in FIG. 6). This holds the switch lever in the position shown in FIG. 6, wherein the electromagnet and an opening in support 36 (through which the switch lever passes) cooperate to hold the lip end 37*a* of the switch lever 37 down low enough such that the finger 31*a* of turn member 31 passes there over as the inclined surface 32*c* slides across contact arm 31*a* allows the turn member 31 to rotate into the transfer position. It is noted that spring 34 is sized large enough so that absent a restraining force from either camming member 32 or switch lever 37, the spring will rotate the turn member 31 into the transfer position.

If a transfer is to be made between the holder 18 and the collar support member 19, the inclined surface 32*c* allows the holder 18 to gently rotate into the transfer position. The transfer position is firmly established by the valley 32*a* which is positioned directly across from the collar support member. Thus, anytime the collar support member passes a holder that is not in its withdrawn position, it will necessarily assume the transfer position due to the influence of the valley portion 32*a* of camming member 32. In the transfer positions, transfers from the holder to the collar support member and vice versa may both occur.

When it is desired to return the holder 18 to the withdrawn position, the electromagnet 35 is merely turned off. This releases the back side of switch lever 37 allowing the spring 38 to return the switch lever to its holding position. The next time the carriage passes by the selected collar holder 18, the camming member 32 forces the turn member to rotate back to the withdrawn position and it is again captured by the switch lever 37 as discussed above.

The structure of the holder 18 will next be described referring to FIGS. 4 and 8. The holder 18 has an elongated base member that is firmly attached to one of the arms of turn member 31. Two support arms 18*a* and 18*b* extend outward from the base. The upper support arm 18*a* is substantially longer than lower support arm 18*b* in order to present the collar 17 held therein to the collar support member 19 in the desired orientation as shown in FIG. 6. Each of the support arms 18*a* and 18*b* have a resilient clamping arrangement that includes a clamping finger 41 that is pivotally coupled to the support arm by a pivot 42. A rounded opening 43 sized to receive a collar is formed by the surface of the support arm and the clamping finger 41. The opening 43 is somewhat C-shaped to firmly grasp a collar positioned therein. A spring 44 biases the finger to assume the C-shaped position shown in FIG. 8. However, during the actual transfer operation the finger can be deflected somewhat in a pivoting manner to facilitate the transfer. The strength of the spring is chosen such that it will readily allow the transfer to occur yet will firmly hold the collars in place absent an influence from the collar support member.

Figure 7:
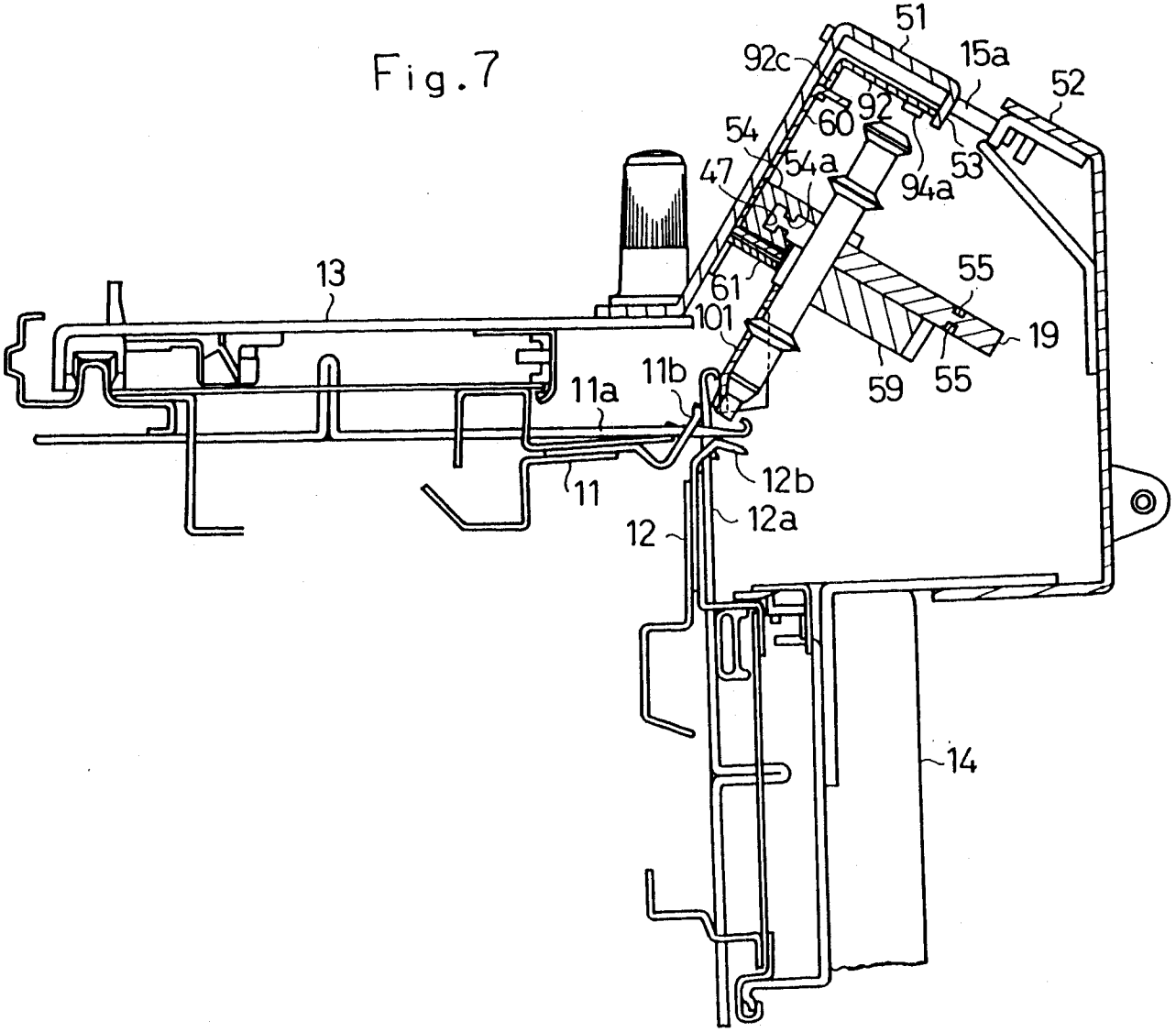
FIG. 7 is a cross-sectional side view of the carriages and the carriage connection device.

The collar support member 19 has a similar clamping structure as well. Specifically, as also seen in FIG. 8, a clamping finger 56 is pivotally coupled to the collar support member 19 by pivot 57. Spring 58 biases the clamping finger to its closed (retaining) position. Referring next to FIGS. 7 and 10, a latch stop board 101 carried by frame 51 extends below the support member 19 to prevent the latches for the hooks on needles 11*a* and 12*a* from closing during the knitting operation. The latch stop board has an indented center portion which serves as a rest for the lower portion of the collar 17 held by the collar support member 19. Thus, the latch stop board positions the collar head between the hooked portions of needles 11*a* and 12*a* as seen in FIG. 7.

Figure 11:
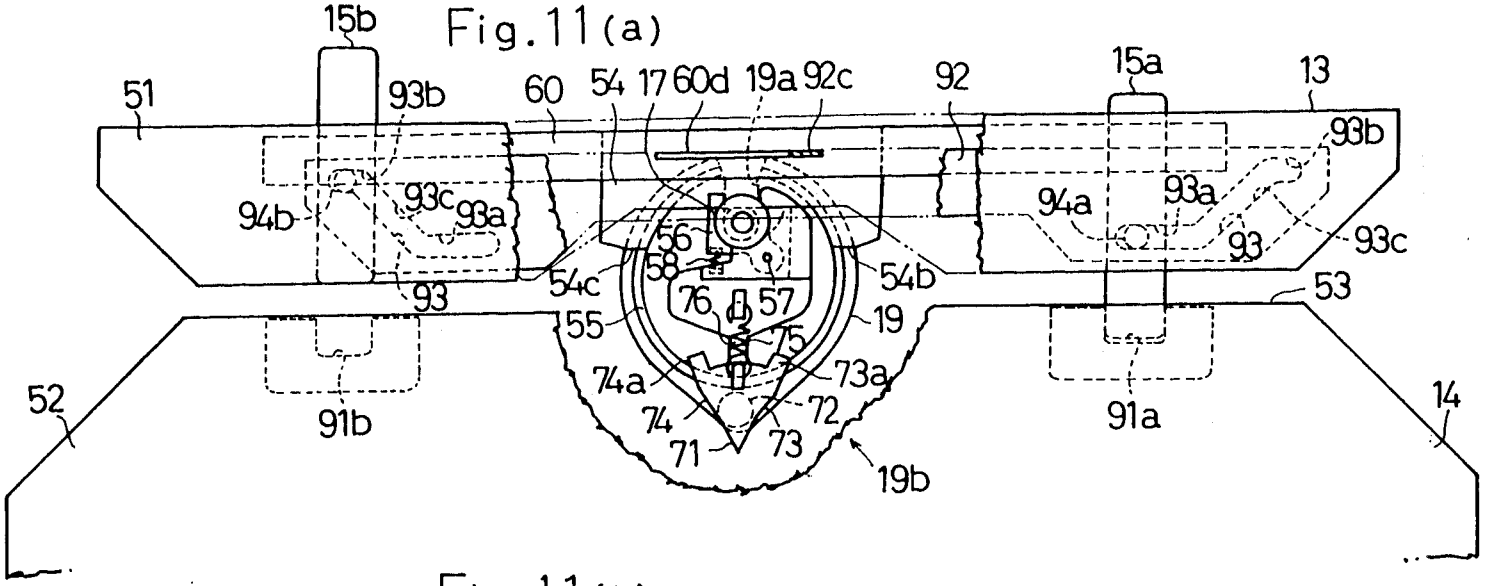
FIG. 11(*a*) is a top plan view of a carriage connecting device designed in accordance with the present invention, wherein the collar support member is oriented in the operational position for knitting.
Figure 11:
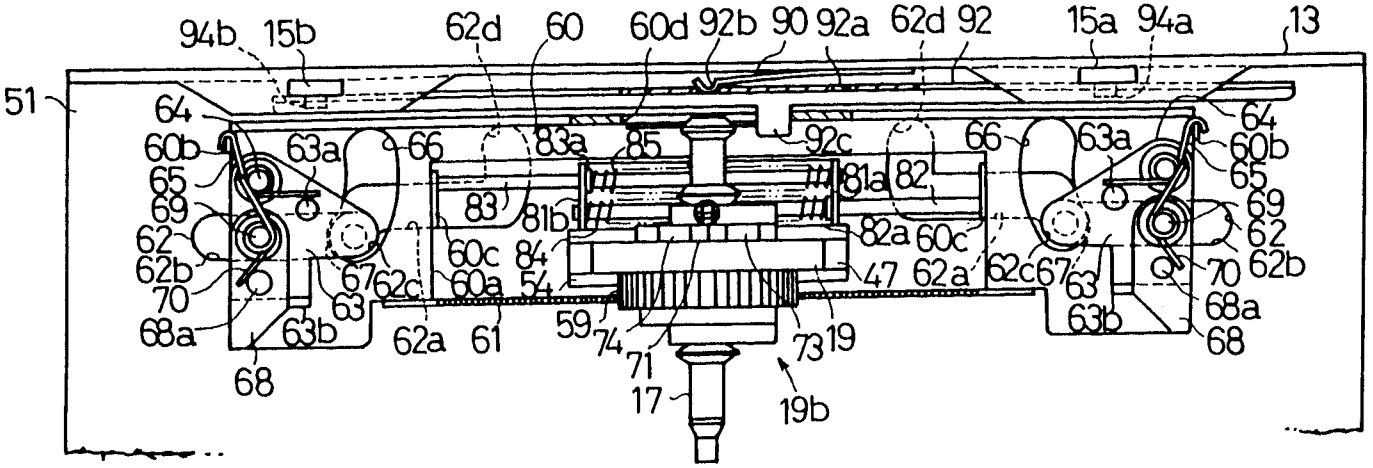
Figure 12A:
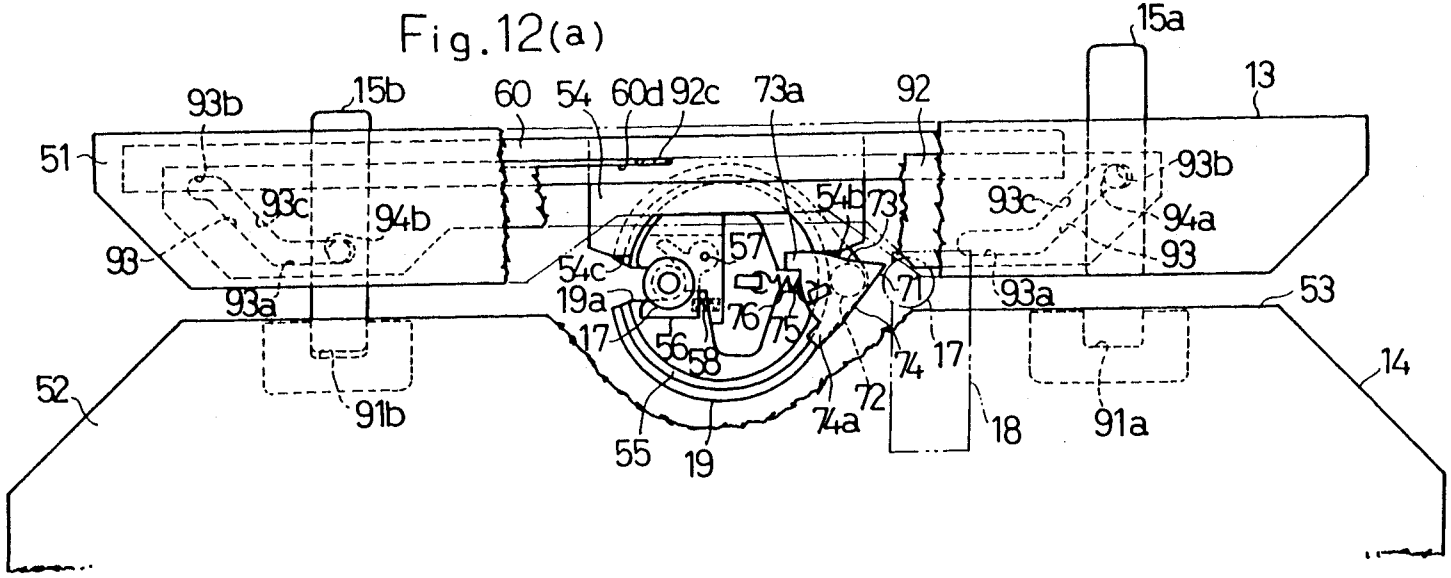
FIG. 12(*a*) is a top plan view of the carriage connecting device shown in FIG. 11(*a*) with the collar support member oriented in its right transfer position.
Figure 12B:
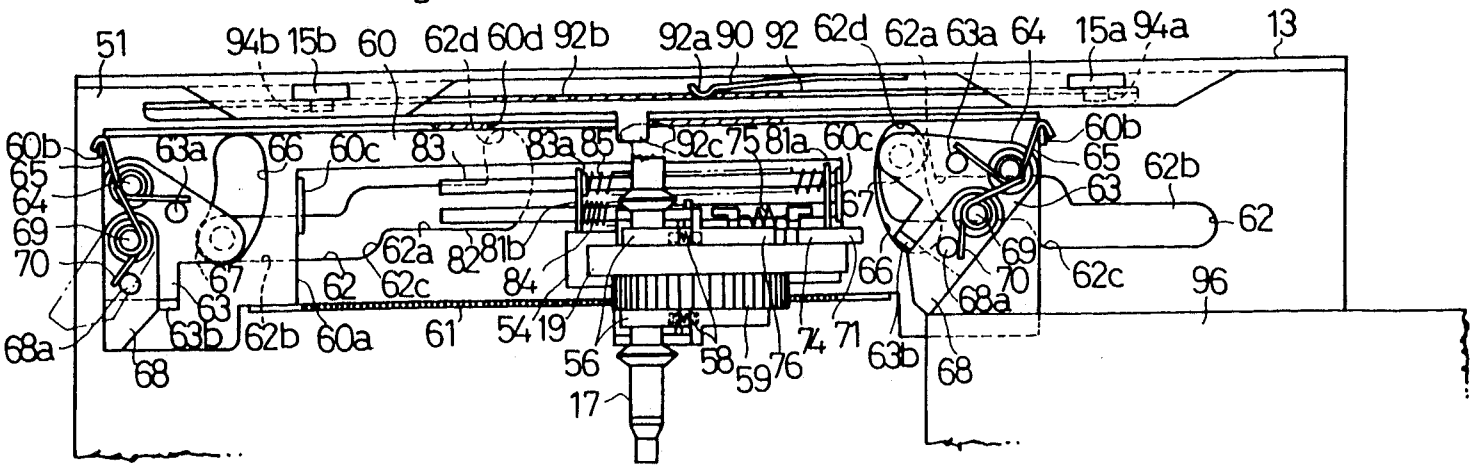

The construction of the yarn changing device 19*b* will be described next. Reference is initially made to FIGS. 7, 11 and 12. Each of the carriages 13 and 14 has a frame, 51 and 52 respectively, mounted thereto. A pair of slide grooves 62 are provided in the frame 51. The slide grooves mirror one another with each groove 62 having a pair of offset elongated straight segments 62*a* and 62*b*, a connecting segment 62*c* that couples the elongated segments and a runout segment 62*d*.

A control plate 60 is slidably mounted to frame 51. The control plate 60 has a toothed rack 61 formed on its bottom surface and a pair of matching followers 63 mounted its opposite sides. Each follower 63 is pivotally mounted to the control plate 60 by pivot 64 and includes an arcuate slot 66 and a nub 63*a* on its front surface. The follower 63 also has a roller 67 that is constrained to movement within both the slide groove 62 on frame 51 and the arcuate slot 66. Thus, as the control plate 60 moves relative to the frame 51, the movements of the follower 63 are dictated by the geometry of the slide groove 62. A bias spring 65 is wound about the pivot 64 and its opposite ends are held by nub 63*a* and a fixed projection 60*b* on control plate 60. Thus, the bias spring 65 always urges the follower member downward as shown FIG. 11*b*.

A contact finger 68 is pivotally coupled to the follower by a pivot 69. Its movements in one direction are constrained by a stop 63*b* which protrudes outward from the front surface of the follower 63. A spring 70 is wrapped around the pivot 69 and its opposite ends are held by a nub 68*a* on contact finger 68 and the pivot 64 on the follower. As can best be seen in FIG. 11*b*, the spring 70 is set so that the contact finger 68 presses against the stop 63*b* and assumes a substantially vertical position when it is unaffected by other parts. In this position the tip of the contact finger extends somewhat below both the follower and the control plate.

The collar support 19 is coupled to the frame 51 by support member 54. As best seen in FIG. 7, the collar support 19 is received within a relatively large support chamber 47 in the support member 54. The collar support has a pair of annular guiding grooves 55 which cooperate with teeth 54*a* on support member 54 to firmly secure the collar support 19 to the frame while allowing it to rotate within the support chamber 47.

A pinion gear 59 is mounted to the lower surface of the follower 19. The pinion gear 59 meshes with the rack 61 carried by the control plate 60. Thus, movements of the control plate 60 relative to the frame 51 translate to rotations of the collar support 19. The yarn changing device is arranged such that in operation, when the carriages move outside of the knitting needle arrays 11*c*, 12*c* on the needle beds, the contact finger 68 engages a block 96 which loosely holds it in place as the frame 51 continues to move further outside the needle array. These movements induce a 90 degree rotation of collar support 19. Once the collar support has been rotated 90 degrees a stopping arrangement causes the control plate to reengage the frame so as that any continued movements away from the needle array are in unison.

It is noted that blocks 96 are provided on both sides of the needle bed and are positioned such that they move the control plate relative to the frame between the needle arrays and the respective collar racks 16. Thus, as mentioned above, the collar support member 19 is rotated before it is aligned with a collar rack 16. In the regions opposite the collar racks, the frame 51 and the control plate 60 travel together.

The relative movements of control plate components of the will next be described. In the operational position, as shown in FIG. 11, the collar support member 19 is centered relative to the control plate 60. In the embodiment shown in FIG. 12, the carriages have moved to the right of the needle beds and the intended rotation of the collar support member 19 has just been completed. In the operational position, the rollers 67 carried by the opposing followers 63 rest at the junctions between the outer straight segments 62*b* and the joining sections 62*c* of their respective slide grooves 62 as seen in FIG. 11.

When the carriage is moved to the right beyond the needle array, the right side contact finger 68 strikes block 96. The stop 63*b* prevents the contact finger from rotating relative to the follower 63. Since both followers 63 are constrained to move only in accordance with the path of slide groove 62, the control plate 60 remains substantially in place while the carriage 13 and its frame 51 continue to move to the right (to the position seen in FIG. 12). Thus, the roller 67 carried by the left hand follower moves along the outer straight segment 62*b* of its associated left slide groove. In contrast, the roller 67 associated with the right hand follower passes along the inner straight segment 62*a* of its associated slide groove. The relative motion of the control plate and the frame stops at the end of the straight segments. Thus, since the purpose of the relative motion is to rotate the support collar 19 by 90 degrees, the length of the straight segments 62*a* and 62*b* are determined by the rack range required to rotate the pinon gear 59 by 90 degrees.

Once the right hand roller 67 has reached the end of the inner straight segment 62*a*, it slides upward along runout 62*d*. This causes both its associated follower 63 and connecting finger 68 to rotate about pivot 64. The runout 62*d*, the contact finger 68 and block 96 are all sized and arranged such that when the roller 67 rotates into runout 62*d*, the contact finger 68 will rotate enough so that it will pass over block 96. As such, the entire carriage may continue past the collar rack 16 as previously described. When the opposing (i.e. left hand) contact finger comes into contact with the control block, it will rotate about pivot 69 against the force of spring 70 (to the position shown by the dashed line in FIG. 12*b*) such that it will also glide over the block 69.

After the desired collar exchange has been completed, the carriage is moved back towards the needle array. Once the contact finger 68 slides off of the block 96, the spring 70 returns it to the upright position against stop 63*b*.

To return the control plate 60 to the operational position, a pair of push rods 82 and 83 are coupled to the frame. A pair of spaced apart support pieces 81*a* and 81*b* are secured to a non-rotating portion of the yarn changing device. Each push rod passes freely through the opposing support pieces, which serve as guides. A washer 82*a*, 83*a* is secured to each push rod to anchor an associated coil spring 84, 85. The coil springs 84 and 85 are journaled about their associated push rods between an associated washer and one of the support pieces. The various components are arranged such that in the operational position, the washers 82*a* and 83*a* are positioned adjacent opposite support pieces as the free ends of their associated springs. One end of each push rod extends into a position adjacent pad 60*c* on the control plate 60. See FIG. 11.

When the control plate 60 translates relative to the frame 51, one of the pads will press against its associated push rod. In the situation shown in FIG. 12, the right pad 60*c* presses against the push rod 82. Thus, as the frame 51 translates to the right relative to the control plate 60, push rod 82 is pushed to the left relative to the support pieces causing washer 82*a* to compress its associated spring 84. When the control plate is free from the influence of the block 96, the compressed spring 84 provides the restoring force to return the control plate to the operational position. Push rod 83 and spring 85 cooperate to produce the same restoring force when the frame translates to the left relative to the control plate.

The actuation of the connecting members 15 will be described next. As indicated above, the connecting members cooperate such that one of the connecting members always couples the carriages 13 and 14 together. The connecting member 15*a* (15*b*) is carried by the carriage 13 and has a plug 94*a* (94*b*) extending slightly upward from its top surface. The plug is received within an associated guide groove 93 in the frame 51. The guide grooves 93 are mirror images of one another and each includes a pair of offset, horizontally extending segments 93*a* and 93*b*, as well as an inclined segment 93*c* which joins the offset segments. The horizontally extending segments 93*a* located to the front of the carriage are substantially longer than the rear segments 93*b*. When a plug 94*a* (94*b*) is located within the front segment 93*a*, then the associated connecting member 15*a* (15*b*) is fully extended such that it engages the latch 91*a* (91*b*) on carriage 14. In contrast, when the plug 94*a* (94*b*) is in a rear segment 93*b* of the guide groove, the guide member 15*a*(15*b*) is withdrawn from its associated latch 91*a* (91*b*).

In order to egress and withdraw the connecting members 15, a sliding plate is coupled to the frame 51 such that it may slide side to side by a short amount. As best seen in FIG. 11, movements of the sliding plate are driven by control plate 60 which mechanically extends and withdraws the connecting members based upon the position of the control plate. The actual mechanical coupling is described in the co-pending application referenced above.

The controller used to control the collar selection and placement operations will be described next. Referring initially to FIG. 1, a central processor (CPU) 111 is provided with extended memories in the form of ROM 112 and RAM 113. The CPU is also connected to a pattern input device 114 which is used to input the fabric patterns desired to be knitted. A suitable pattern input device is described in Japanese laid open patent application No. 64-45855, which is incorporated herein by reference. The routines required to operate electromagnet 35 and drive motor 117 are stored within the ROM 112.

The RAM 113 is a read/write device and is typically used to store information which will vary depending upon the actual fabrics being knitted. This includes color arrangement data, information indicative of the number of yarns to be used to knit the desired pattern and yarn placement data. All of this information may be received from the pattern input device. Information concerning the pattern of the materials to be knitted as well as the number of yarn colors that will be required is collectively referred to as the color arrangement data. The yarn placement data indicates which rack each active yarn will be stored in.

As best shown in FIG. 1, a control circuit 115 is provided for operating the electromagnets 35 at the direction of the CPU 111. Similarly, carriage drive circuitry 116 is provided to actually control the movements of the carriage drive motor 117 at the direction of the CPU 111. The position sensors 26*a* and 26*b* both communicate directly with the CPU.

In operation, the CPU monitors the position sensors 26*a* and 26*b*. When a signal is received indicating that the carriage has arrived at one of the ends of the machine (as indicated by the position sensors), the CPU looks up which yarn is required for the next knitting stage and directs the electromagnets 35 and carriage drive circuitry accordingly.

Figure 15A:
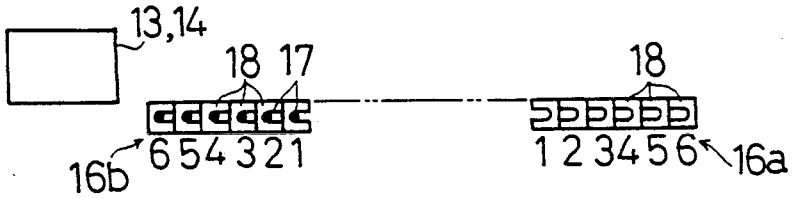
FIGS. 15(*a*)–15(*v*) are schematic diagrams showing the actual carriage and holder movements necessary to establish the yarn distribution state shown in FIG. 13*a*.
Figure 15B:
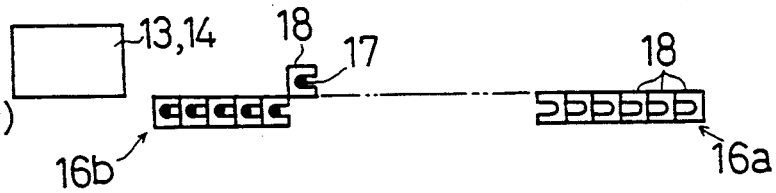
Figure 15C:
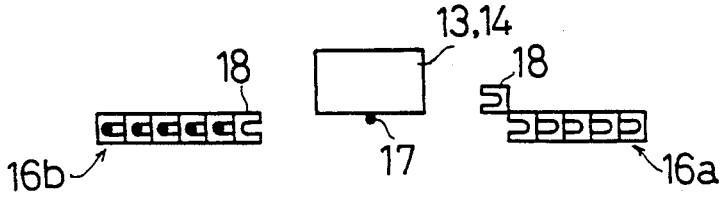
Figure 15D:
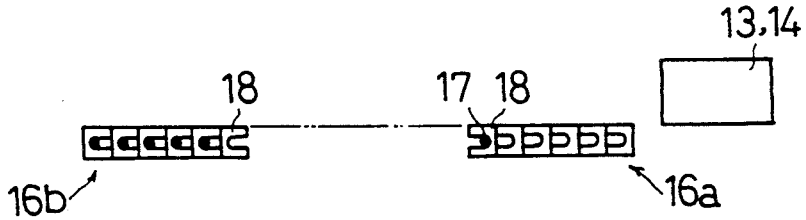
Figure 15E:
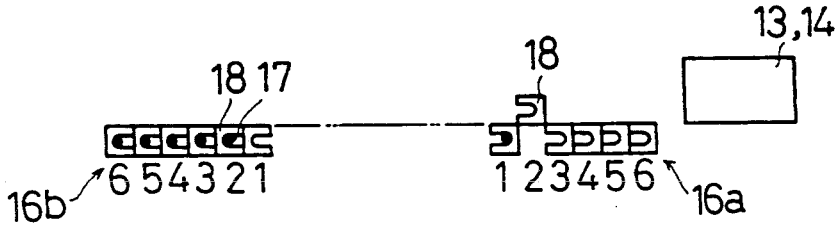
Figure 15F:
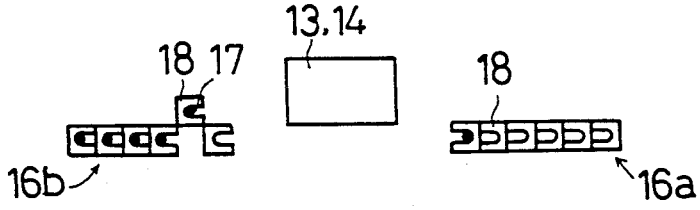
Figure 15G:
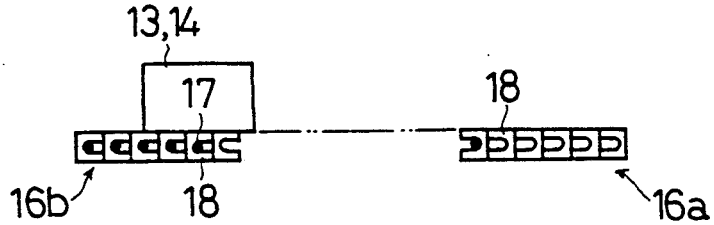
Figure 15H:
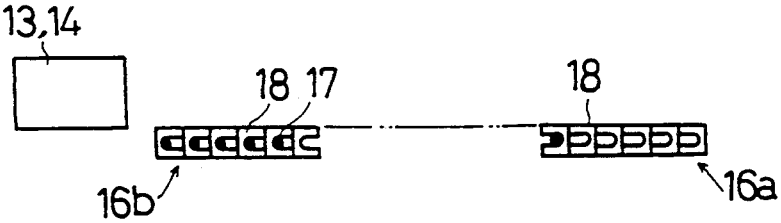
Figure 15I:
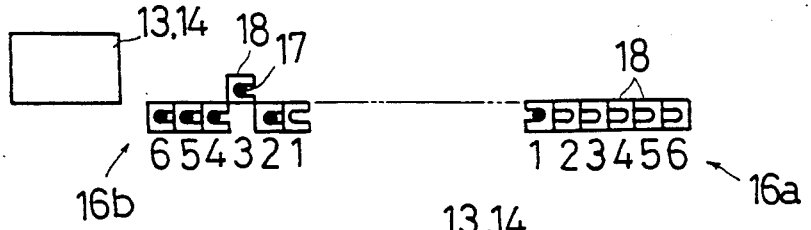
Figure 15J:
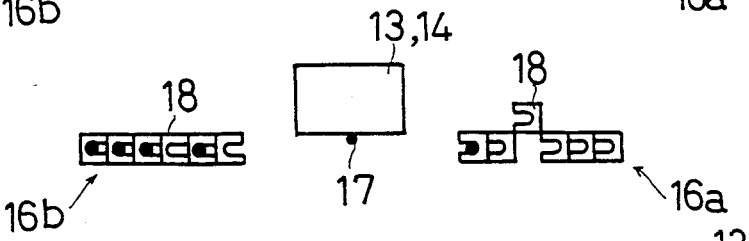
Figure 15K:
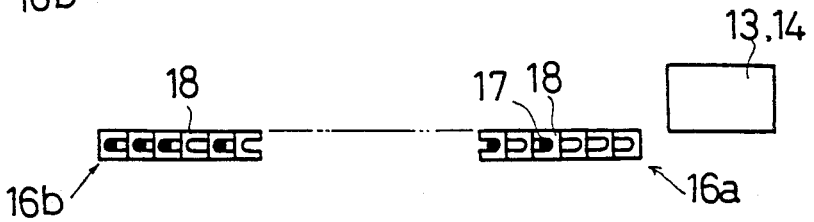
Figure 15L:
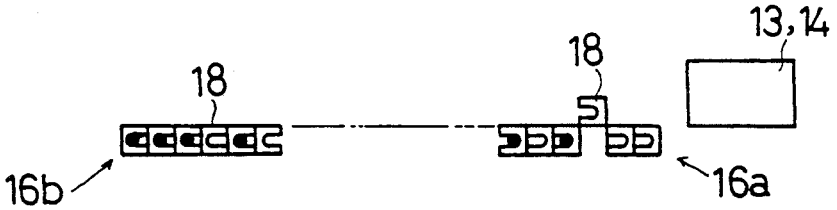
Figure 15M:
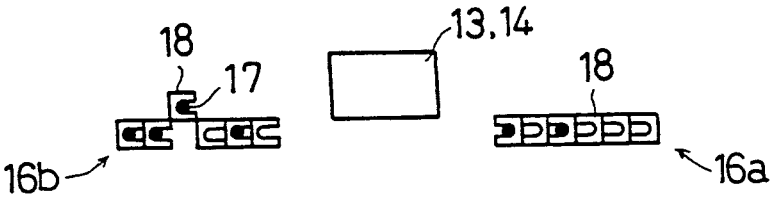
Figure 15N:
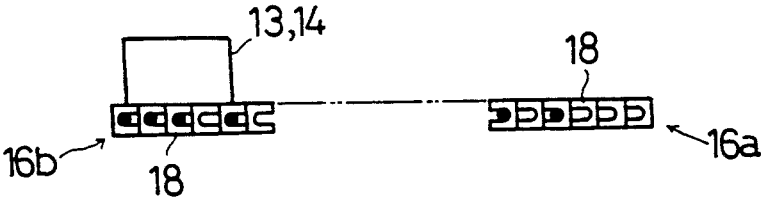
Figure 15O:
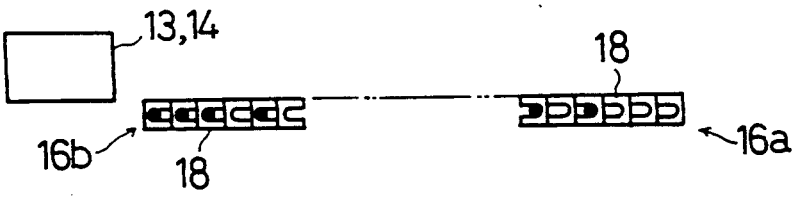
Figure 15P:
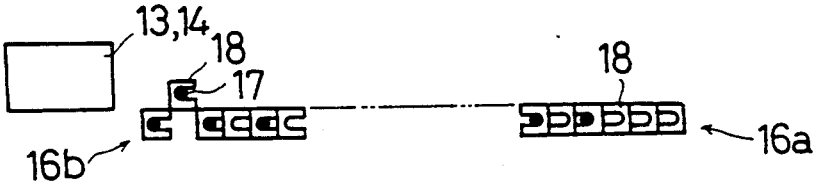

To initiate a knitting operation, the yarns are strung as described above and placed in their associated holders. Typically, all of the yarn collars would initially be placed in one of the collar support racks. In the example provided herein, it will be assumed that the yarns are initially placed in the left collar support rack. Thus, the collars are initially located as shown in FIG. 15*a*. Importantly, it is not necessary for the operator to place the collars in one rack or the other based upon the fabrics to be knitted. Rather, this operation is done automatically. It is noted that FIGS. 15*a*–15*v* are all schematic diagrams indicating the steps taken to position the various collars 17 before knitting commences. The exchanges required to position the collars before knitting are carried out as described above with respect to FIGS. 3*a*–3*j*.

Referring next to FIGS. 14*a* and 14*b*, a suitable control algorithm for positioning the collars prior to knitting will be described. After startup, the color arrangement data is read from RAM 113. If the appropriate color arrangement data is not already available within the RAM, then it would first be input through pattern input device 114. Within the color arrangement data includes an indication of the desired starting positions for each of the yarns to be used. For clarity, these reading operations will be referred to as step S1. The additional described steps will be similarly designated.

Figures 13, 14:
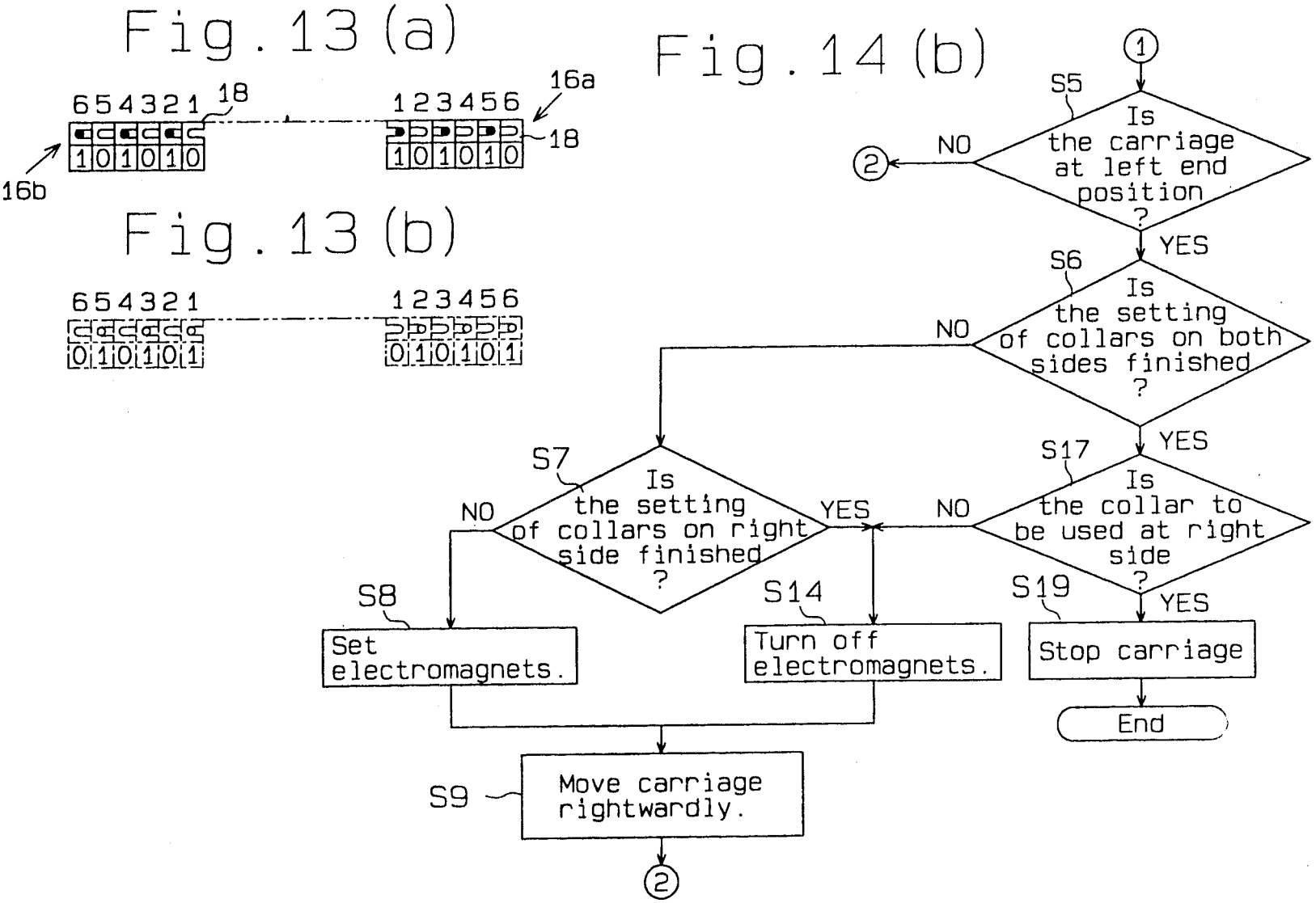
FIG. 13(*a*) shows a desired yarn distribution state prior to beginning the knitting operation.
FIGS. 14(*a*) and 14(*b*) are flow diagrams of a control routine suitable for distributing the yarns to a desired yarn distribution state.
Figure 14:
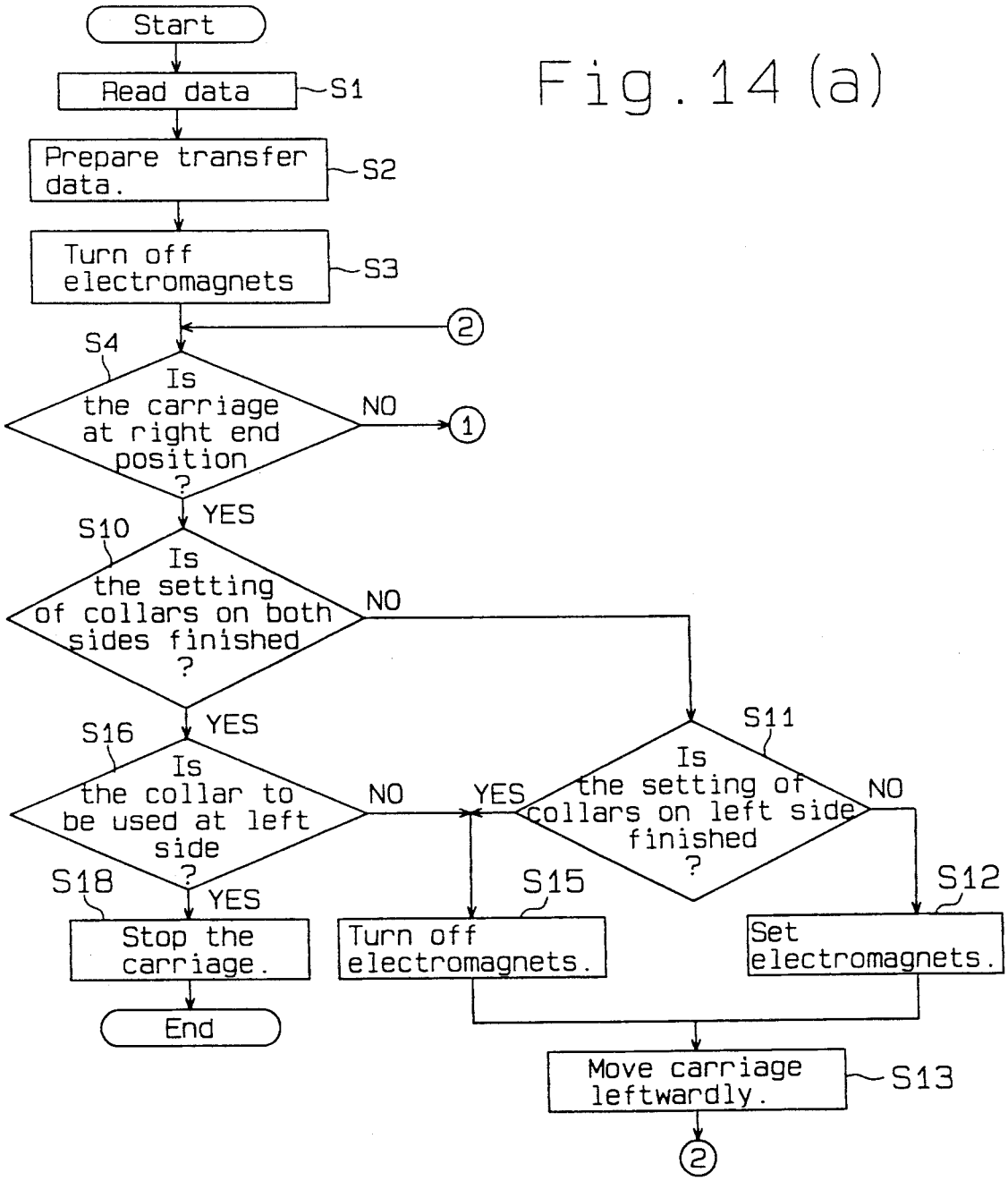

Although the desired starting positions of the various yarns will depend to a great extent upon the particular pattern being knitted, for the purposes of illustration it will be assumed that the desired initial positions are those shown in FIG. 13*a*. The desired distribution of the yarn collars within each collar support rack may be represented digitally as a six bit word as shown in FIG. 13 with each bit indicating the presence or absence of a collar within its associated holder in the left collar support rack. Thus, a "1" indicates the presence of a collar within the holder and a "0" indicates the absence of a collar within the holder.

After reading the color arrangement data, the CPU 111 then determines transfer data, in which each of the bits is reversed. Digitally, the transfer data is the twos complement of the six bit word. If any electromagnet(s) 35 is on, it is switched off. (Step S3). In the next logical step S4, the controller asks if the carriage is in the right end position. In the example, the carriages 13 and 14 are initially placed at the left hand side of the needle bed as seen in FIG. 15*a*. Thus, the judgment in step S4 would be "No" and the program advances to step S5 as seen in FIG. 14*b*. In step S5, the CPU determines if the carriage is at the left end position. If not it returns to step S4. However, in this case the correct judgment would be "Yes" and the CPU proceeds to step S6 wherein it judges whether all of the collars in both collar racks are properly placed. (Step S6). When the result of this judgment is "No", the CPU checks whether all of the collars intended for initial placement in the right support rack are properly positioned. (Step S7). These inquiries are extremely simple in nature. Since no feedback is provided which indicates the position of the collars, the controller merely places the collars in serial order. That is the collar #1 is placed first, collar #2 is placed second and so on.

Figure 15:
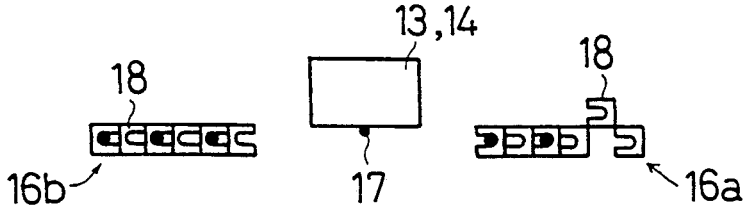
Figure 15:
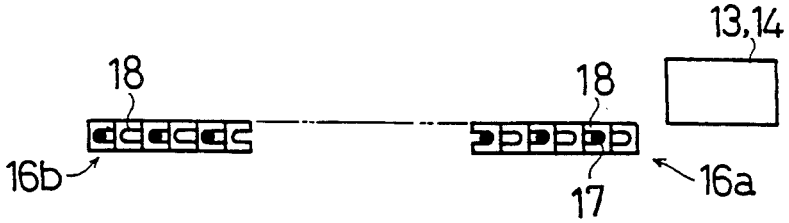
Figure 15:
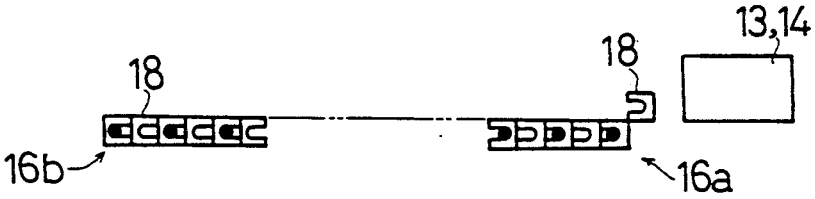
Figure 15:
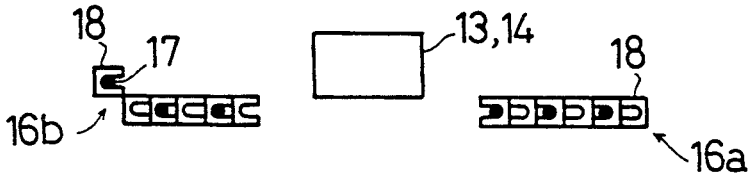
Figure 15:
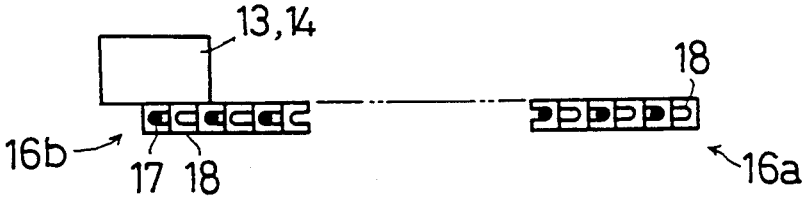
Figure 15:
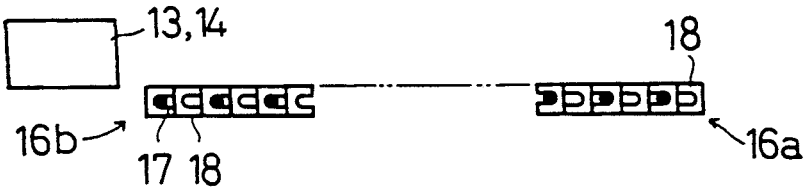

The controller then determines which holder should be activated. This is done be reading the transfer data corresponding to the rack located adjacent the side of the needle bed that is opposite the carriages' current position. In this case, since the carriages are located on the left side of the needle bed, the transfer data corresponding to the right racks is read. The transfer data indicates a "zero" in the bit corresponding to holder #1. This indicates that the collar in holder No. 1 should be transferred to the right side and the CPU energizes the electromagnets 35 within each rack which correspond to the selected holders #1 are activated. (Step S8). The carriage drive motor 117 is then actuated to transport the carriages to the right side of the needle bed. (Step S9). Once the electromagnets have been actuated, the holders 18 will be actuated and the selected collar will be transferred to the collar support member 19 as described above. Thus, collar #1 is transferred to the opposite rack. It is noted that even thought both electromagnets are turned on at the same time, the holders do not both rotate into the transfer position at the same time since switch lever 37 will retain turn member 31 until the camming member 32 passes thereby as described above. The movements of the carriages and holders are seen in FIGS. 15(*a*)–15(*d*).

At this point the controller logically proceeds back to the point marked 2, and repeats step S4. When the carriage arrives in the far right position, as detected by position sensor 26*a*, the result of judgment S4 becomes "Yes" and the program continues to step S10.

At this point the CPU checks to determine if all of the collars are properly positioned. If not, it proceeds to step S11 where it checks whether all of the collars to be positioned in the left rack are properly positioned. In this case, the result will be "No" since only one collar has been positioned and the controller proceeds to step S12. In the next step, the controller looks at the transfer data corresponding to holder #2 in the left rack and sees a zero. Thus it directs the same motions described above except that it tries to move the collar to the left. That is, the electromagnets corresponding to holders #2 are set S12 and the carriage is moved to the left S13 as seen in FIGS. 15(*e*) through 15(*g*). However, since collar #2 is already positioned to the left, nothing is picked up as the carriage passes by the activated, but empty holder #2 in the right rack 16*a*. Similarly the mechanism previously described prevents a collision within the left rack 16*b* from occurring when the collar support rack encounters the extended holder #2 in the left support rack which already has a collar 17 therein. It is noted that if a "1" is seen in the transfer data from the right end, the carriages would be moved to the left as described, but during the next stage, the inquiry for collar #2 would be repeated.

The control algorithm then waits for the carriage to arrive at the left side of the needle bed and returns to step S5 in the control process. After proceeding to the left side of the needle bed, the carriages stop adjacent the left position sensor 26*b* as seen in FIG. 15(*h*). At this point the judgment step S5 observes that the carriage is positioned at the left end positions. Thus, it proceeds to step S6 as described above. Since the collars are not all properly set, the result of judgment step S6 is "No" and the process described above is repeated as the carriages move to the right. This time, as seen in FIGS. 15(*h*)–15(*k*), the third holders are activated as the carriage moves to the right. The routines described above are then repeated for the fourth, fifth and sixth collars, as shown diagrammatically in FIGS. 15(*l*) through 15(*v*).

It is noted that when the judgment of step S7 (S11) become "Yes", the controller proceeds to step S14 (S15) (which turn off all of the electromagnets) before proceeding to the opposite side of the needle bed. Step S9 (S13). Once all of the collars have been distributed, the judgment of steps S6 and S10 are both "Yes" and the distribution of collars ends. If the carriage is in the right side position and all of the collars are properly positioned, the result of Judgment S10 is "Yes" and the controller proceeds to step S16 where the CPU determines whether the carriages are located on the correct side of the needle bed to begin the knitting operation. This is done by referring to the color arrangement data.

If the carriage is properly positioned, the result of step 16 is "Yes", the carriage is stopped and the collar placement routine is terminated. If, on the other hand, it is desirable to place the carriage on the left side of the needle bed for its initial placement, the result of step S16 is "No" and the controller proceeds to steps S15 and S13 to move the carriage to the left. It is noted that step S15 turns off all electromagnets 35. When the carriage arrives at the left side of the needle bed, the result of judgment step S5 is "Yes" and the logic proceeds through steps S6 and S17 both of which are answered affirmatively. The controller then proceeds to step S19 where the carriage is stopped and the collar placement program ends. At this point the collar knitting machine is ready for knitting to proceed.

The described controller is extremely simple to use and is very efficient. Therefore, minimal operator effort and skill are necessary to initially configure the knitting machine for a wide variety of different textile patterns.

Although only one embodiment of the present invention has been described in detail herein, it should be apparent to those skilled in the art that the present invention may be embodied in many other specific forms without departing from the spirit or scope of the invention. For example, the number of holders within each storage supply rack may be readily varied dependent upon the desired size of the machine. The actual hardware used within the controller and the particular comparisons performed by the controller may also both be widely varied without departing from the spirit of the invention. Therefore, the present examples and embodiments are to be considered illustrative and not restrictive and the invention is not to be limited to the details given herein, but may be modified within the scope of the appended claims.

What is claimed is:

1. A flat bed knitting machine comprising:

a needle bed having a knitting section;

a carriage slidably mounted on the needle bed, the carriage including yarn support means for selectively receiving a yarn;

first and second yarn support racks for holding a plurality of yarns, each yarn support rack having a plurality of holders for detachably holding an associated yarn and wherein each said yarn has an associated holder in both the first and second yarn support racks, the holders each having a transfer position and a withdrawn position;

holder driving means for moving said holders between their withdrawn and transfer positions to facilitate transferring the yarns between said yarn support means and their associate holders;

carriage driving means for moving said carriage relative to the needle bed;

data storage means for storing data indicative of the desired initial positions of said yarns before knitting begins; and control means for directing said holder driving means and said carriage driving means in response to information stored within said data storage means in order to preset the yarns into the desired initial positions for knitting.

2. A knitting machine as recited in claim 1 wherein the yarn support racks are located on opposite ends of said needle bed and each yarn support rack has at least as many holders as the number of said yarns.

3. A knitting machine as recited in claim 2 wherein the various holder pairs are arranged sequentially from inside to outside of the needle bed and wherein the yarn arrangement presetting function is accomplished by transferring the yarns only between their associated holder pairs.

4. A knitting machine as recited in claim 3 further comprising a pair of position sensors for detecting the location of said carriage along said needle bed.

5. A flat bed knitting machine comprising:

a needle bed having a knitting section;

a carriage slidably mounted on the needle bed, the carriage including yarn support means for selectively receiving a yarn, wherein said yarn support means delivers the active yarn to the knitting section during knitting operations;

first and second yarn support racks located on opposite ends of said needle bed for holding a plurality of yarns to be used during knitting, each yarn support rack having a plurality of holders for detachably holding an associated yarn, the holders each having a transfer position and a withdrawn position and being arranged sequentially from inside to outside of the needle bed with the holders from the opposing yarn support racks being paired such that each holder pair has a particular associated yarn;

holder driving means for moving said holders between their withdrawn and transfer positions;

carriage driving means for moving said carriage back and forth along the needle bed;

a pair of position sensors for detecting the location of said carriage along said needle bed;

data storage means for storing data indicative of the desired initial positions of said yarns before knitting begins; and control means for directing said holder driving means and said carriage driving means in response to information stored within said data storage means in order to preset the yarns into the desired initial positions, wherein during said presetting the yarns are only transferred between their associated holder pairs.

* * * * *